US011450269B2

(12) United States Patent
Baek

(10) Patent No.: US 11,450,269 B2
(45) Date of Patent: Sep. 20, 2022

(54) DISPLAY DEVICE AND COMPENSATION METHOD

(71) Applicant: LG Display Co., Ltd., Seoul (KR)

(72) Inventor: Lokdam Baek, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/136,960

(22) Filed: Dec. 29, 2020

(65) Prior Publication Data

US 2021/0201775 A1 Jul. 1, 2021

(30) Foreign Application Priority Data

Dec. 30, 2019 (KR) ..... 10-2019-0178288

(51) Int. Cl.
*G09G 3/3225* (2016.01)
*G09G 3/3266* (2016.01)
*G09G 3/3275* (2016.01)

(52) U.S. Cl.
CPC ..... *G09G 3/3225* (2013.01); *G09G 3/3266* (2013.01); *G09G 3/3275* (2013.01); *G09G 2300/0443* (2013.01); *G09G 2310/0286* (2013.01); *G09G 2320/0242* (2013.01); *G09G 2320/043* (2013.01)

(58) Field of Classification Search
CPC .. G09G 3/3225; G09G 3/3266; G09G 3/3275; G09G 2300/0443; G09G 2310/0286; G09G 2320/0242; G09G 2320/043
See application file for complete search history.

(56) References Cited

U.S. PATENT DOCUMENTS

| | | | | |
|---|---|---|---|---|
| 2015/0213757 | A1 | 7/2015 | Takahama et al. | |
| 2016/0012800 | A1 | 1/2016 | Han et al. | |
| 2017/0061865 | A1* | 3/2017 | Park | G09G 3/325 |
| 2017/0270879 | A1 | 9/2017 | Han et al. | |
| 2018/0151124 | A1* | 5/2018 | An | G09G 3/3233 |
| 2018/0151125 | A1* | 5/2018 | Lee | G09G 3/3275 |
| 2018/0337682 | A1* | 11/2018 | Takasugi | G09G 3/3266 |
| 2019/0073939 | A1* | 3/2019 | Hu | G09G 3/2092 |

* cited by examiner

*Primary Examiner* — Michael A Faragalla
*Assistant Examiner* — Sujit Shah
(74) *Attorney, Agent, or Firm* — Seed IP Law Group LLP

(57) ABSTRACT

The present disclosure relates to a display device and a compensation method and more particularly to a method for sensing mobility of a driving TFT of subpixels while an image is being driven by a display device, and a display device performing the method. A sensing method for compensation, which is performed while a display device is being driven, includes charging, in an $N^{th}$ frame period, a node M of a shift register A connected to a $j^{th}$ gate line of a display panel. The method also includes charging, in the $N^{th}$ frame period, a node M of a shift register B connected to a $K^{th}$ gate line of the display panel. The method further includes sensing, in a next blank period to the $N^{th}$ frame period, subpixels connected to the $j^{th}$ gate line and sensing subpixels connected to the $K^{th}$ gate line in the blank period.

15 Claims, 31 Drawing Sheets

DISPLAY DEVICE AND COMPENSATION METHOD

CROSS REFERENCE TO RELATED APPLICATION

The present application claims priority to Korean Patent Application No. 10-2019-0178288, filed Dec. 30, 2019, the entire contents of which is incorporated herein for all purposes by this reference.

BACKGROUND

Technical Field

The present disclosure relates to a display device and a compensation method and more particularly to a method for sensing mobility of a driving TFT of subpixels while an image is being driven by a display device, and a display device performing the method.

Description of the Related Art

With the development of information society, various types of display devices are being developed. Recently, a variety of display devices such as a liquid crystal display (LCD), a plasma display panel (PDP), and an organic light emitting display (OLED) are being used.

An organic light emitting device constituting the OLED emits light by itself, and thus, does not require a separate light source. Therefore, the thickness and weight of the display device can be reduced. Also, the OLED shows high quality characteristics, for example, low power consumption, high luminance, and high response speed, etc.

BRIEF SUMMARY

Technical Problem

As discussed above, the OLED shows high quality characteristics, for example, low power consumption, high luminance, and high response speed, etc. However, such an OLED may have degradation in a display quality due to the characteristics of transistors included within the OLED or due to the degradation of the organic light emitting device.

In order to solve the above-described problems, in various embodiments, the present disclosure provides a method for sensing the characteristics of a driving transistor of a subpixel and to provide a display device which is driven by the method.

Technical Solution

One embodiment is a sensing method for compensation, which is performed while a display device is being driven. The sensing method includes: charging, in an $N^{th}$ frame period, a node M of a shift register A connected to a $j^{th}$ gate line of a display panel; charging, in the $N^{th}$ frame period, a node M of a shift register B connected to a $K^{th}$ gate line of the display panel; sensing, in a next blank period to the $N^{th}$ frame period, subpixels connected to the $j^{th}$ gate line; and sensing subpixels connected to the $K^{th}$ gate line in the blank period.

After the sensing subpixels connected to the $j^{th}$ gate line is terminated, the sensing subpixels connected to the $K^{th}$ gate line is performed.

The sensing subpixels connected to the $j^{th}$ gate line includes: sensing the subpixels having a first color among the subpixels connected to the $j^{th}$ gate line; and sensing the subpixels having a second color among the subpixels connected to the $j^{th}$ gate line.

The sensing subpixels connected to the $K^{th}$ gate line includes: sensing the subpixels having a first color among the subpixels connected to the $K^{th}$ gate line; and sensing the subpixels having a second color among the subpixels connected to the $K^{th}$ gate line.

The charging a node M of a shift register A includes a step in which the shift register A receives an LSP A signal through a line connected in a local way. The charging a node M of a shift register B includes a step in which the shift register B receives an LSP B signal through a line connected in a local way.

The sensing the subpixels having a first color among the subpixels connected to the $j^{th}$ gate line includes: a step in which the shift register A receives an RST1 A signal through a line connected in a local way; and a step in which a carry charged in the node M of the shift register A moves to a node Q, and then the node Q of the shift register A is charged.

The sensing method further includes, after the subpixels having a first color are sensed, a step in which the shift register A receives an RST2 signal through a line connected in a global way; and a step in which the node Q of the shift register A is discharged.

The sensing the subpixels having a first color among the subpixels connected to the $K^{th}$ gate line includes: a step in which the shift register B receives an RST1 A signal through a line connected in a local way; and a step in which a carry charged in the node M of the shift register B moves to a node Q, and then the node Q of the shift register B is charged.

The sensing method further includes, after the subpixels having a first color are sensed, a step in which the shift register B receives an RST2 signal through a line connected in a global way; and a step in which the node Q of the shift register B is discharged.

In the blank period, the subpixels having a first color and the subpixels having a second color among the subpixels connected to the $j^{th}$ gate line are sensed. In the blank period, the subpixels having a first color and the subpixels having a second color among the subpixels connected to the $K^{th}$ gate line are sensed.

Another embodiment is a display device which performs sensing for compensation, which is performed while the display device is being driven. The display device includes: a display panel including a plurality of subpixels; a gate driver which is connected with the subpixels through gate lines including a $j^{th}$ gate line and a $K^{th}$ gate line; and a data driver which is connected to the subpixels through a data line. The gate driver includes: a shift register A which receives an RST2 signal in a global way, receives an LSP A signal and an RST1 A signal in a local way, and is connected with the $j^{th}$ gate line; and a shift register B which receives the RST2 signal in a global way, receives an LSP B signal and an RST1 B signal in a local way, and is connected with the $K^{th}$ gate line.

In an $N^{th}$ frame period, a node M of the shift register A is charged. In the $N^{th}$ frame period, a node M of the shift register B is charged.

In a next blank period to the $N^{th}$ frame period, the subpixels connected to the $j^{th}$ gate line are sensed. In the blank period, the subpixels connected to the $K^{th}$ gate line are sensed.

The sensed subpixels connected to the $j^{th}$ gate line include the subpixels having a first color and the subpixels having a second color.

The sensed subpixels connected to the $K^{th}$ gate line include the subpixels having a first color and the subpixels having a second color.

The shift register A receives the LSP A signal through a line connected in a local way. The shift register B receives the LSP B signal through a line connected in a local way.

The shift register A receives the RST1 A signal through a line connected in a local way before the subpixels having a first color are sensed.

The shift register A receives the RST2 signal through a line connected in a global way after the subpixels having a first color are sensed.

The shift register B receives the RST1 B signal through a line connected in a local way before the subpixels having a first color are sensed.

The shift register B receives the RST2 signal through a line connected in a global way after the subpixels having a first color are sensed.

In a blank period between the $N^{th}$ frame period and an $N+1^{th}$ frame period, a portion of subpixels among the subpixels connected to the $j^{th}$ gate line are sensed. In the blank period, a portion of subpixels among the subpixels connected to the $K^{th}$ gate line are sensed.

The sensed subpixels connected to the $j^{th}$ gate line are the subpixels having a first color and the subpixels having a second color. The sensed subpixels connected to the $K^{th}$ gate line are the subpixels having a first color and the subpixels having a second color.

Advantageous Effects

According to the embodiment of the present disclosure, mobility of a driving TFT of a subpixel can be sensed while an image is being driven by the display device.

According to the embodiment of the present disclosure, a tact time can be reduced in sensing the driving TFT of the subpixel.

According to the embodiment of the present disclosure, the image quality of a display panel can be improved.

DETAILED DESCRIPTION

Figure 1:
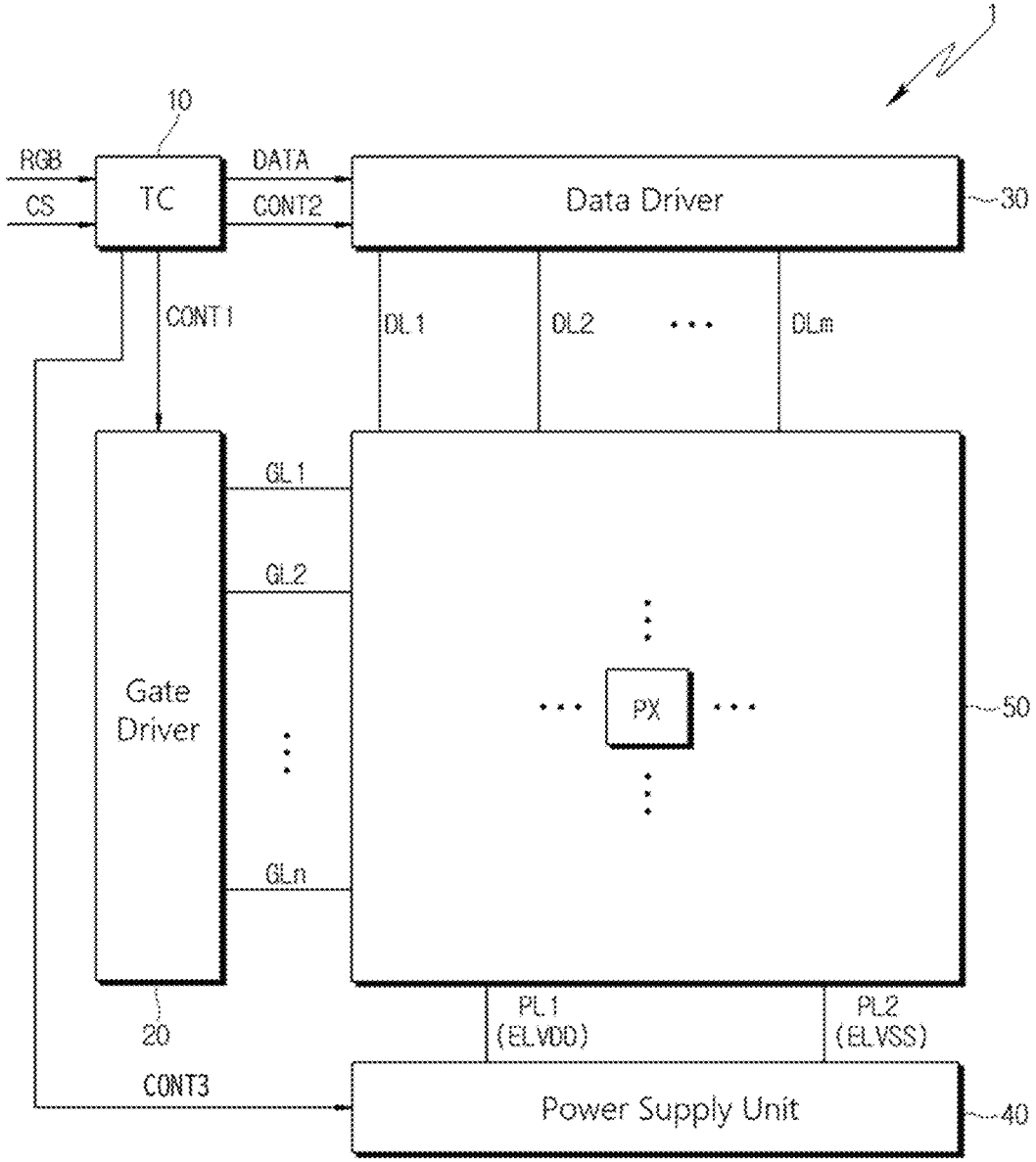
FIG. 1 is a block diagram showing a configuration of a display device according to an embodiment of the present disclosure.

Hereinafter, embodiments of the present disclosure will be described with reference to the accompanying drawings. In this specification, when it is mentioned that a component (or region, layer, portion) "is on," "is connected to," or "is combined with" another component, terms "is on," "connected to," or "combined with" mean that a component may be directly connected to/combined with another component or mean that a third component may be disposed between them.

The same reference numerals correspond to the same components. Also, in the drawings, the thicknesses, ratios, and dimensions of the components are exaggerated for effective description of the technical details. A term "and/or" includes all of one or more combinations that related configurations can define.

While terms such as the first and the second, etc., can be used to describe various components, the components are not limited by the terms mentioned above. The terms are used only for distinguishing between one component and other components. For example, the first component may be designated as the second component without departing from the scope of rights of various embodiments. Similarly, the second component may be designated as the first component. An expression of a singular form includes the expression of plural form thereof unless otherwise explicitly mentioned in the context.

Terms such as "below," "lower," "above," "upper" and the like are used to describe the relationships between the components shown in the drawings. These terms have relative concepts and are described based on directions indicated in the drawings.

In the present specification, it should be understood that the term "include" or "comprise" and the like is intended to specify characteristics, numbers, steps, operations, components, parts or any combination thereof described in the specification, and intended not to previously exclude the possibility of existence or addition of at least one another characteristics, numbers, steps, operations, components, parts or any combination thereof.

FIG. 1 is a block diagram showing a configuration of a display device according to the embodiment of the present disclosure.

Referring to FIG. 1, the display device 1 includes a timing controller 10, a gate driver 20, a data driver 30, a power supply unit 40, and a display panel 50.

The timing controller 10 may receive an image signal RGB and a control signal CS from the outside. The image signal RGB may include a plurality of gradation data. The control signal CS may include, for example, a horizontal synchronization signal, a vertical synchronization signal, and a main clock signal.

The timing controller 10 may process the image signal RGB and the control signal CS in conformity with operation conditions of the display panel 50, and then may output an image data (DATA), a gate driving control signal CONT1, a data driving control signal CONT2, a power supply control signal CONT3.

The gate driver 20 may be connected with pixels PX of the display panel 50 through a plurality of gate lines GL1 to GLn. The gate driver 20 may generate gate signals on the basis of the gate driving control signal CONT1 output from the timing controller 10. The gate driver 20 may provide the generated gate signals to the pixels PX through the plurality of gate lines GL1 to GLn.

The data driver 30 may be connected with the pixels PX of the display panel 50 through a plurality of data lines DL1 to DLn. The data driver 30 may generate data signals on the basis of the image data (DATA) and the data driving control signal CONT2 output from the timing controller 10. The data driver 30 may output the generated data signals to the pixels PX through the plurality of data lines DL1 to DLn.

The power supply unit 40 may be connected with the pixels PX of the display panel 50 through a plurality of power lines PL1 and PL2. The power supply unit 40 may generate a driving voltage supplied to the display panel 50, on the basis of the power supply control signal CONT3. The driving voltage may include, for example, a high potential driving voltage (ELVDD) and a low potential driving voltage (ELVSS). The power supply unit 40 may provide the generated driving voltages ELVDD and ELVSS to the pixels PX through the power lines PL1 and PL2 corresponding thereto.

A plurality of the pixels PX are disposed on the display panel 50. For example, the pixels PX may be disposed on the display panel 50 in the form of a matrix.

Each pixel PX may be electrically connected to the gate line and the data line which correspond thereto. Such pixels PX may emit light with a luminance which corresponds to the gate signal and the data signal which are provided through the gate lines GL1 to GLn and the data lines DL1 to DLn.

Each pixel PX may represent any one of a first to third colors. For example, each pixel PX may represent any one of red, green, and blue colors. For another example, each pixel PX may represent any one of cyan, magenta and yellow colors. For further another example, the pixels PX may represent any one of four or more colors. For instance, each pixel PX may represent any one of red, green, blue, and white colors.

The timing controller 10, the gate driver 20, the data driver 30, and the power supply unit 40 may be configured as a separate integrated circuit (IC) respectively or may be configured as an IC in which at least some of them are integrated. For example, at least one of the data driver 30 and the power supply unit 40 may be configured as an IC integrated with the timing controller 10.

Also, while the gate driver 20 and the data driver 30 are shown in FIG. 1 as separate components from the display panel 50, at least one of the gate driver 20 and the data driver 30 may be implemented in an in-panel method where it is formed integrally with the display panel 50. For example, the gate driver 20 may be formed integrally with the display panel 50 in a gate-in-panel (GIP) method.

Figure 2:
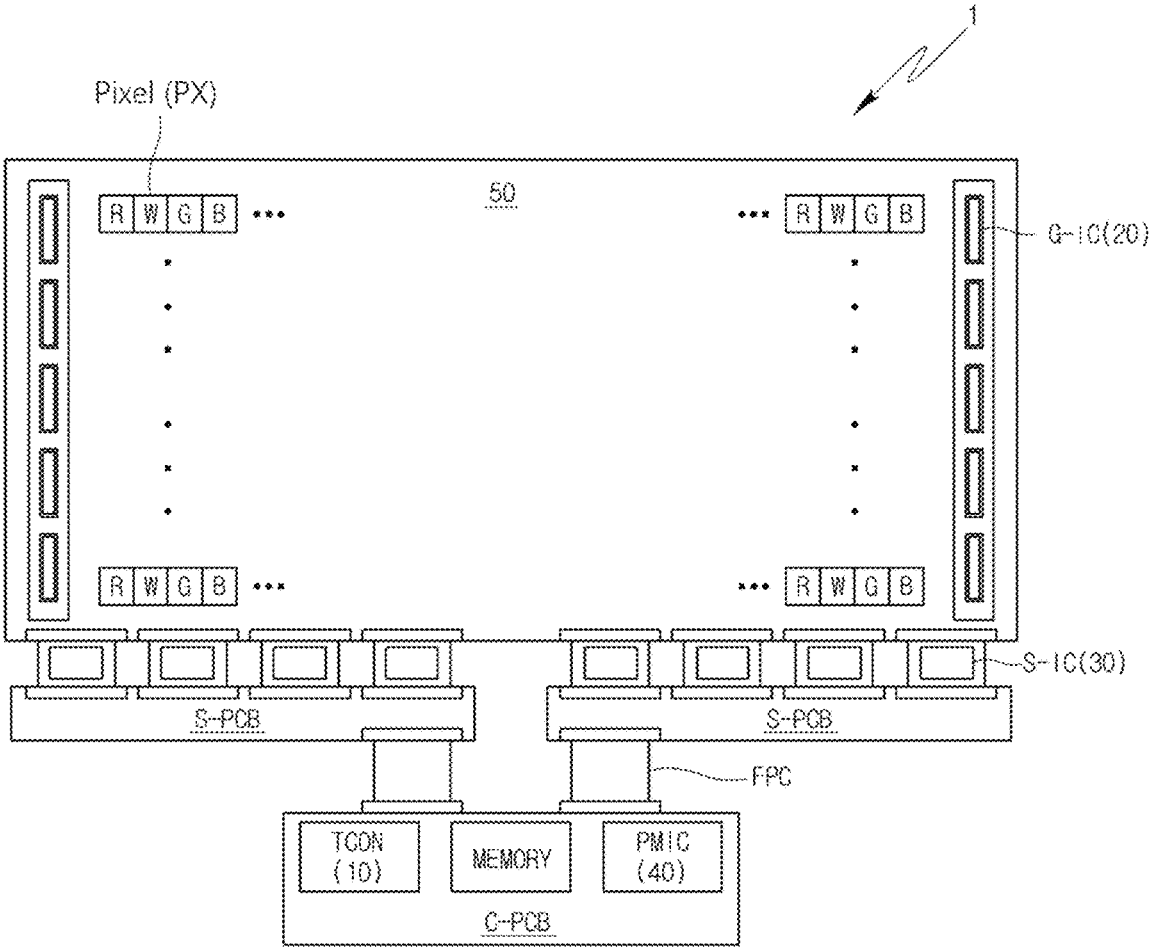
FIG. 2 is a view showing the display panel according to the embodiment of the present disclosure.

FIG. 2 is a view showing the display panel according to the embodiment of the present disclosure.

Referring to FIG. 2, the rectangular display panel 50 is shown and the display panel 50 includes a plurality of the pixels PX arranged therewithin in the form of columns and rows. For example, the plurality of pixels PX may include four subpixels, and the four subpixels may be a red subpixel, a white subpixel, a green subpixel, and a blue subpixel, respectively.

Also, the display device 1 includes the gate driving IC (G-IC) 20. The display panel 50 may be implemented in a gate-in-panel (GIP) method in which the gate driving IC 20 is disposed within the display panel. The gate driving IC 20 may be attached to the left, right or right and left sides of the display panel 50.

Also, the display device 1 includes the data driving IC (source driving IC: S-IC) 30. The source driving IC 30 may be attached below the display panel 50. A plurality of the source driving ICs 30 may be attached in the transverse direction of the display panel 50. Such a source driving IC 30 may be implemented in a chip on film (COF) method where it is disposed within a flexible PCB (FPCB), a chip on glass (COG) method where it is disposed on a glass substrate constituting the display panel 50, and the like. For example, in the embodiment shown in FIG. 2, the source driving IC 30 is implemented in the COF method, and the FPCB connects the display panel 50 and a source PCB (S-PCB) through pad connection. The source driving IC 30 may transmit a voltage (source IC driving voltage, EVDD, EVSS, VREF, etc.) provided to the display panel 50 from a control PCB (C-PCB).

The source PCB (S-PCB) may be connected to the display panel 50 from below the display panel 50 through the FPCB, and may be connected to the control PCB (C-PCB) through a flexible plat cable (FPC) connection. The source PCB (S-PCB) is directly connected to the source driving IC 30 and transmits the gate signal to the gate driving IC 20. Also, the source PCB (S-PCB) receives power (ELVDD, ELVSS, VGH, VHL, VREF, etc.) from the control PCB (C-PCB) and transmits it to the display panel 50. Also, a connection between the control PCB (C-PCB) and the gate driving IC 20 is provided through the leftmost or rightmost source driving IC 30 of the source PCB (S-PCB). For example, a gate driving IC driving voltage, a gate high voltage (VGH), a gate low voltage (VGL), etc., are transferred from the control PCB (C-PCB) to the gate driving IC 20 through the source PCB (S-PCB).

The control PCB (C-PCB) is disposed below the display panel 50 and is connected to the display panel 50 through the source PCB (S-PCB) and the cable (FPC). The control PCB (C-PCB) may include the timing controller (TCON) 10, the power supply unit 40, and a memory. The description of the timing controller 10 and the power supply unit 40 is the same as the description with reference to FIG. 1. Also, the control PCB (C-PCB) calculates an algorithm for every frame of an output image data to be output, stores compensation data, and requires an area for storing various parameters required for the algorithm calculation or various parameters for tuning. Accordingly, a volatile memory and/or a non-volatile memory may be placed on the control PCB (C-PCB).

Figure 3:
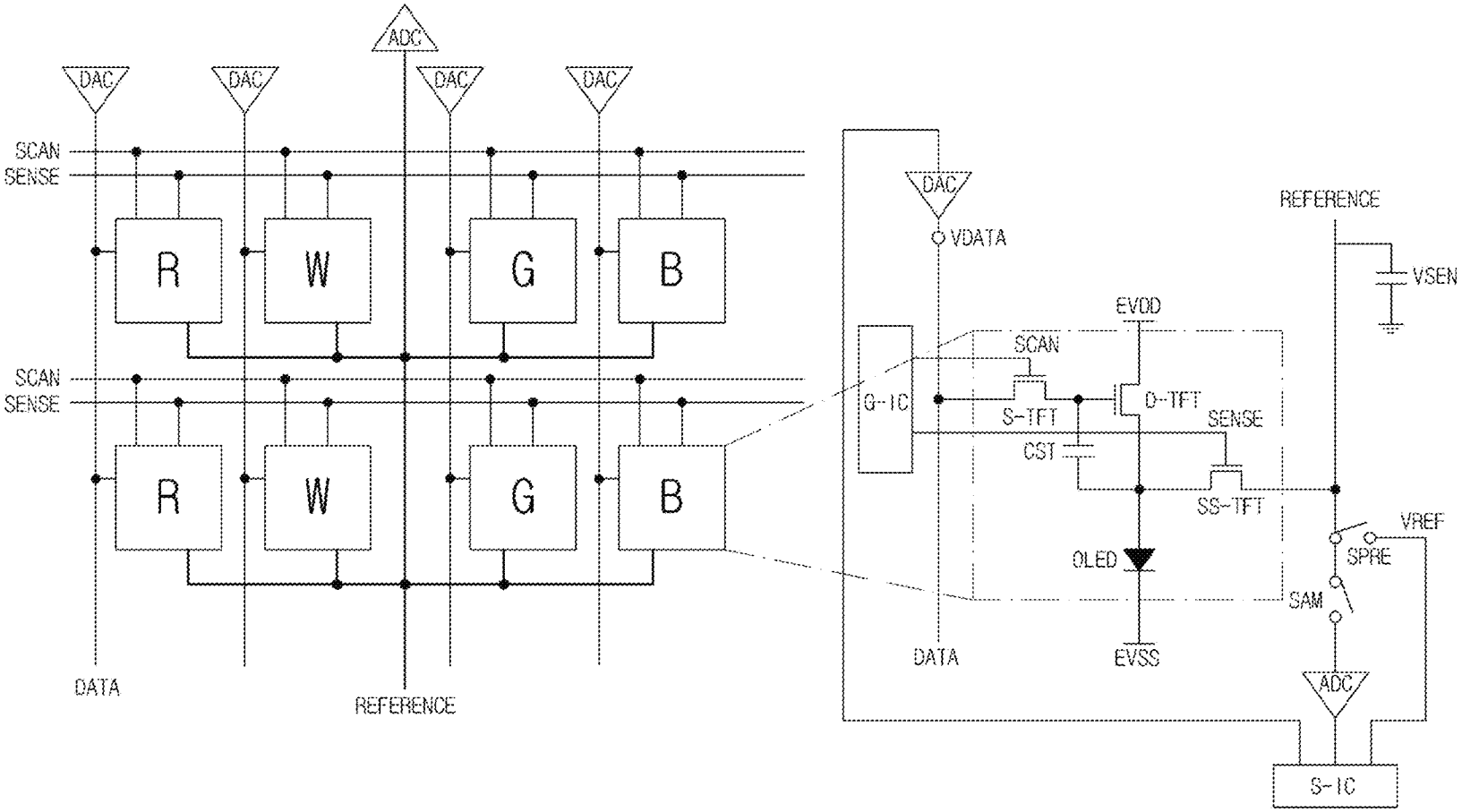
FIG. 3 is view for describing a structure of a pixel according to the embodiment of the present disclosure.

FIG. 3 is view for describing a structure of the pixel according to the embodiment of the present disclosure.

Referring to FIG. 3, one pixel includes four subpixels R, W, G, and B, and each of the subpixels is connected to the gate driving IC (G-IC), a scan line SCAN, and a sensing line SENSE, and is connected through the source driving IC (S-IC) and a reference line. Also, each subpixel receives a data voltage VDATA from the source driving IC (S-IC) through a digital analog converter (DAC). Also, a sensing voltage VSEN output from each subpixel is provided to the source driving IC (S-IC) through an analog digital converter (ADC). Also, each subpixel is connected to the high potential driving voltage (ELVDD) and the low potential driving voltage (ELVSS).

Each subpixel includes a scan TFT (S-TFT), a driving TFT (D-TFT), and a sensing TFT (SS-TFT). Also, each subpixel includes a storage capacitor CST and a light emitting device (OLED).

A first electrode (e.g., a source electrode) of the scan transistor (S-TFT) is connected to the data lines DATA and DL, and the data voltage VDATA is output from the source driving IC (S-IC) and is applied to the data line through the DAC. A second electrode (e.g., a drain electrode) of the scan transistor (S-TFT) is connected to one end of the storage capacitor CST and is connected to a gate electrode of the driving TFT (D-TFT). The gate electrode of the scan transistor (S-TFT) is connected to the scan line (or the gate line GL). That is, the scan transistor (S-TFT) is turned on when the gate signal at a gate-on level is applied through the scan line SCAN, so that the data signal applied through the data line DATA is transferred to one end of the storage capacitor CST.

One end of the storage capacitor CST is connected to a third electrode (e.g., a drain electrode) of the scan TFT (S-TFT). The other end of the storage capacitor CST is configured to receive the high potential driving voltage ELVDD. The storage capacitor CST may charge a voltage corresponding to a difference between a voltage applied to one end thereof and the high potential driving voltage ELVDD applied to the other end thereof. Also, the storage capacitor CST may charge a voltage corresponding to a difference between the voltage applied to one end thereof and a reference voltage VREF applied to the other end thereof through a switch SPRE and the sensing TFT (SS-TFT).

A first electrode (e.g., a source electrode) of the driving transistor (D-TFT) is configured to receive the high potential driving voltage ELVDD, and a second electrode (e.g., a drain electrode) is connected to a first electrode (e.g., an anode electrode) of the light emitting device (OLED). A third electrode (e.g., a gate electrode) of the driving transistor (D-TFT) is connected to one end of the storage capacitor CST. The driving transistor (D-TFT) is turned on when a voltage at the gate-on level is applied, and may control an amount of a driving current flowing through the light emitting device (OLED) in response to a voltage provided to the gate electrode. That is, the current is determined by a voltage difference in the driving TFT (D-TFT) Vgs (or a storage voltage difference in the storage capacitor CST) and is applied to the light emitting element (OLED).

A first electrode (e.g., a source electrode) of the sensing TFT (SS-TFT) is connected to the reference line REFERENCE, and a second electrode (e.g., a drain electrode) is connected to the other end of the storage capacitor CST. A third electrode (e.g., a gate electrode) is connected to the sensing line SENSE. That is, the sensing TFT (SS-TFT) is turned on by a sensing signal SENSE output from the gate driving IC (G-IC) and applies the reference voltage VREF to the other end of the storage capacitor CST. If both the switch SPRE and a switch SAM are turned off and the sensing TFT (SS-TFT) is turned on, the storage voltage of the storage capacitor CST is transferred to the capacitor of the reference line, and the sensing voltage VSEN is stored in the capacitor of the reference line.

If the switch SPRE is turned off and the switch SAM is turned on, the voltage VSEN stored in the reference line capacitor is output to the source driving IC (S-IC) through the ADC. This output voltage is used soon as a voltage for sensing and sampling the degradation of a corresponding subpixel. That is, a voltage for compensating for a corresponding subpixel can be sensed and sampled. Specifically, the characteristics of the driving TFT (D-TFT) are classified into two types of mobility and threshold voltage, and the compensation can be implemented by sensing the mobility and threshold voltage of the driving TFT (D-TFT). Also, the characteristics of the corresponding subpixel may be also determined by the degradation of the light emitting element (OLED), and it is necessary to sense and compensate for the degree of degradation of the light emitting element (OLED). Hereinafter, each driving method for each type of compensation will be described.

Meanwhile, the light emitting device (OLED) outputs light corresponding to the driving current. The light emitting element (OLED) may output light corresponding to any one of red, white, green, and blue colors. The light emitting device (OLED) may be an organic light emitting diode (OLED) or a micro inorganic light emitting diode having a size in a range from micro scale to nano scale. However, the light emitting device (OLED) of the present disclosure is not limited thereto. Hereinafter, the technical spirit of the present disclosure will be described with reference to the embodiment in which the light emitting device (OLED) is composed of the organic light emitting diode.

FIG. 3 shows an example in which a switching transistor (ST), the driving transistor (D-TFT), and the sensing transistor SS-TFT are NMOS transistors. However, the present disclosure is not limited thereto. For example, at least some or all of the transistors constituting each pixel PX may be composed of a PMOS transistor. In various embodiments, each of the switching transistor (ST) and the driving transistor (D-TFT) may be implemented with a low temperature poly silicon (LTPS) thin film transistor, an oxide thin film transistor, or a low temperature polycrystalline oxide (LTPO) thin film transistor.

Also, in the description with reference to FIG. 3, it is shown that four subpixels share one reference line. However, the present disclosure is not limited thereto. A multiple number of subpixels may share one reference line REFERENCE, or each subpixel may be connected to one reference line REFERENCE. In the present specification, for convenience of description, as shown in FIG. 3, it is described that four subpixels share one reference line REFERENCE, and it should be construed as an example.

FIGS. 4A to 4D are views for describing compensation for a mobility feature when the display device is initially driven. That is, the compensation in the present description is performed during a short period of time before the image data is output after the display device is powered on. Also, the compensation in the present description corresponds to compensation for correcting the deviation by sensing the mobility feature of the driving TFT.

Figure 4A:
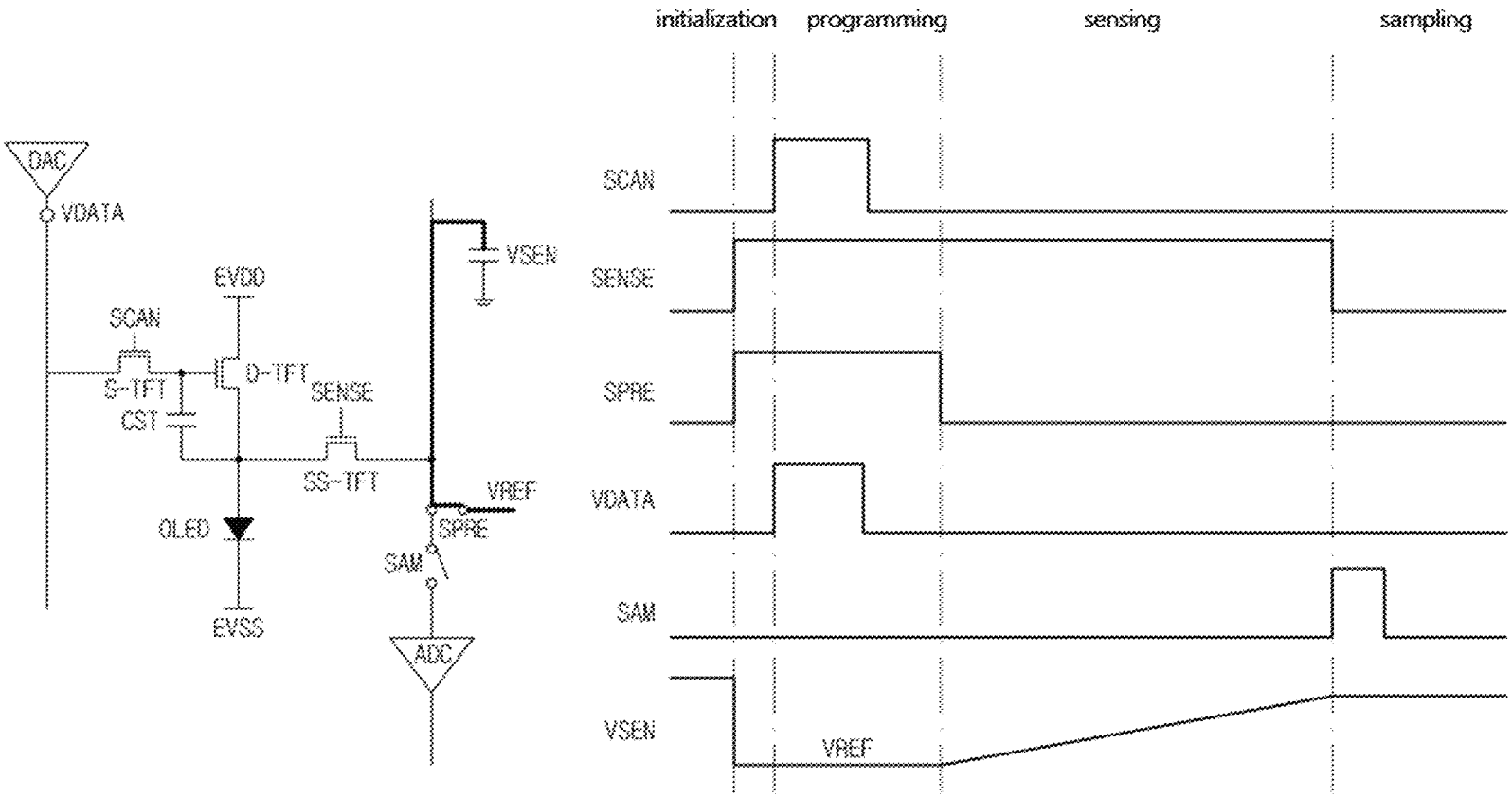
FIGS. 4A to 4D are views for describing compensation for a mobility feature when the display device is initially driven.

Referring to FIG. 4A, the switch SPRE is turned on in an initialization period. Accordingly, the sensing voltage VSEN stored in the capacitor of the reference line is equal to the reference voltage VREF.

Figure 4B:
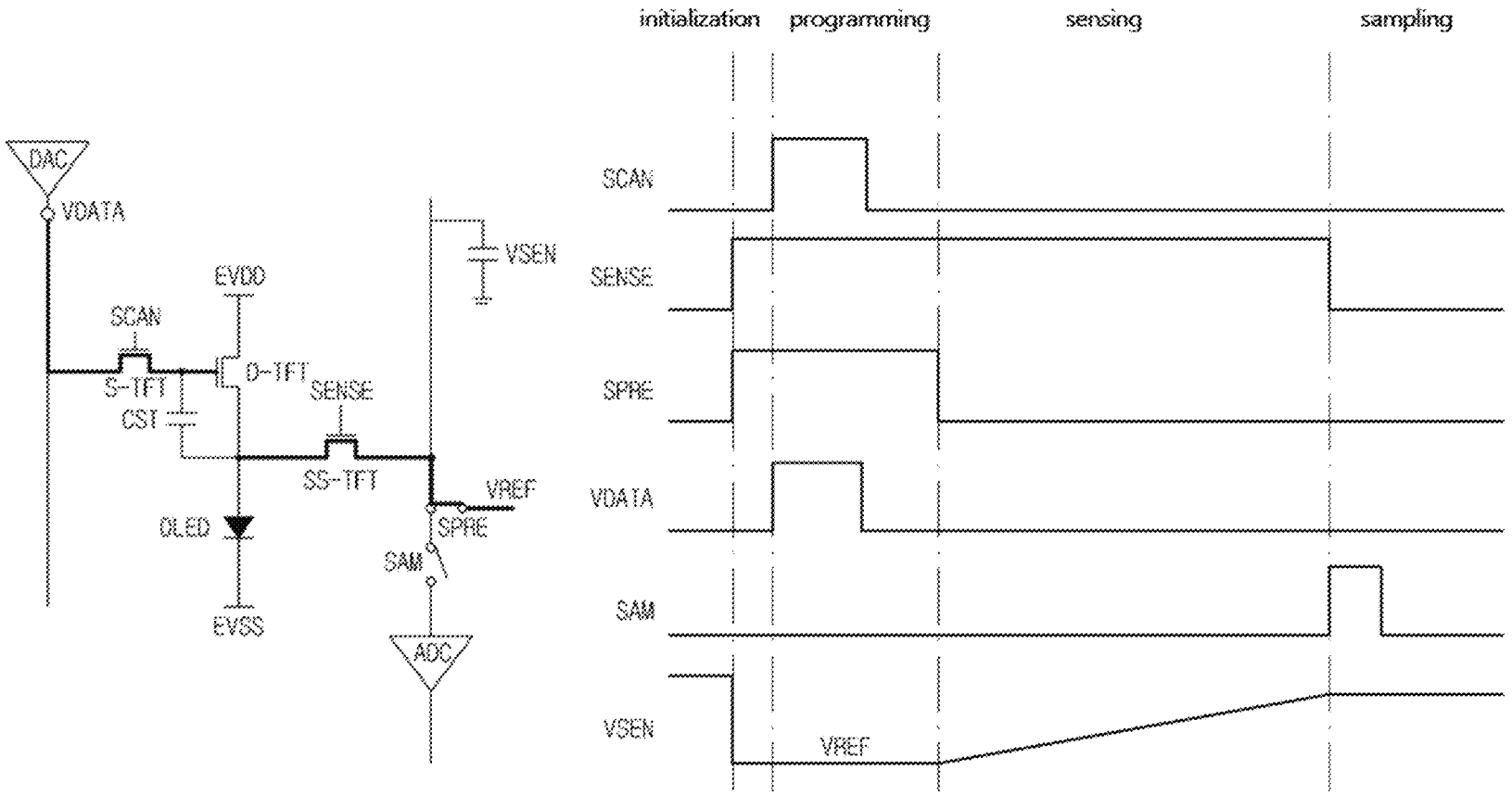

Referring to FIG. 4B, the scan TFT (S-TFT) is turned on in a programming period. Also, the data voltage VDATA is a high voltage. Accordingly, a charge corresponding to the data voltage VDATA is charged at one end of the storage capacitor CST. Also, in the programming period, the sensing TFT (SS-TFT) is turned on and the switch SPRE is turned on. Accordingly, the other end of the storage capacitor CST is charged with a charge corresponding to the reference voltage VREF. That is, the voltage across the storage capacitor CST corresponds to a difference between the data voltage VDATA and the reference voltage VREF. Meanwhile, since the switch SPRE is maintained to be turned on, the sensing voltage VSEN is maintained as the reference voltage VREF.

Figure 4C:
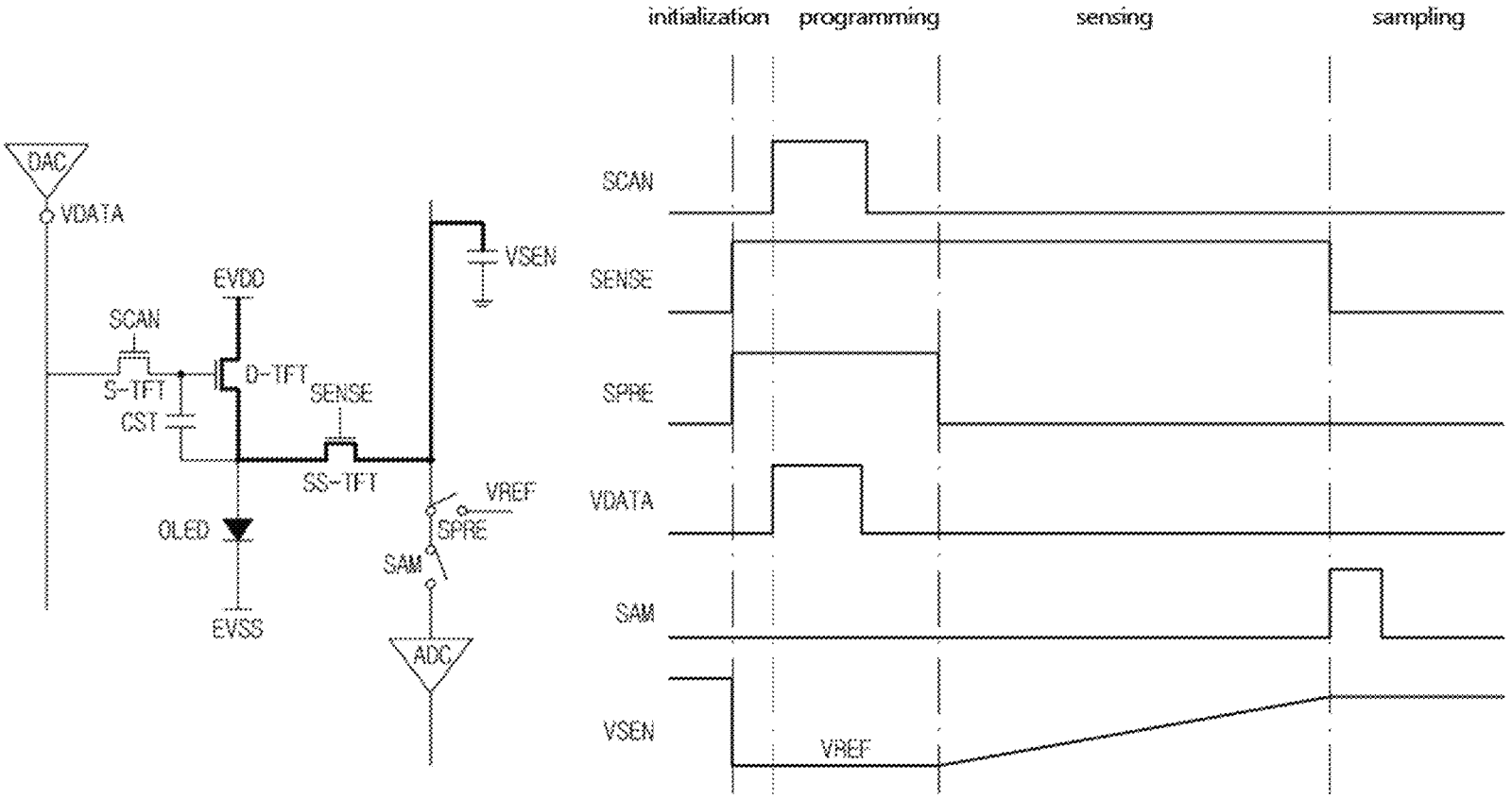

Referring to FIG. 4C, in a sensing period, the scan TFT (S-TFT) is turned off and the sensing TFT (SS-TFT) is turned on. Accordingly, the driving TFT (D-TFT) operates like a constant current source with a constant magnitude, and the current is applied to a reference capacitor through the sensing TFT (SS-TFT). Accordingly, the sensing voltage VSEN increases with a constant voltage increase over time.

Figure 4D:
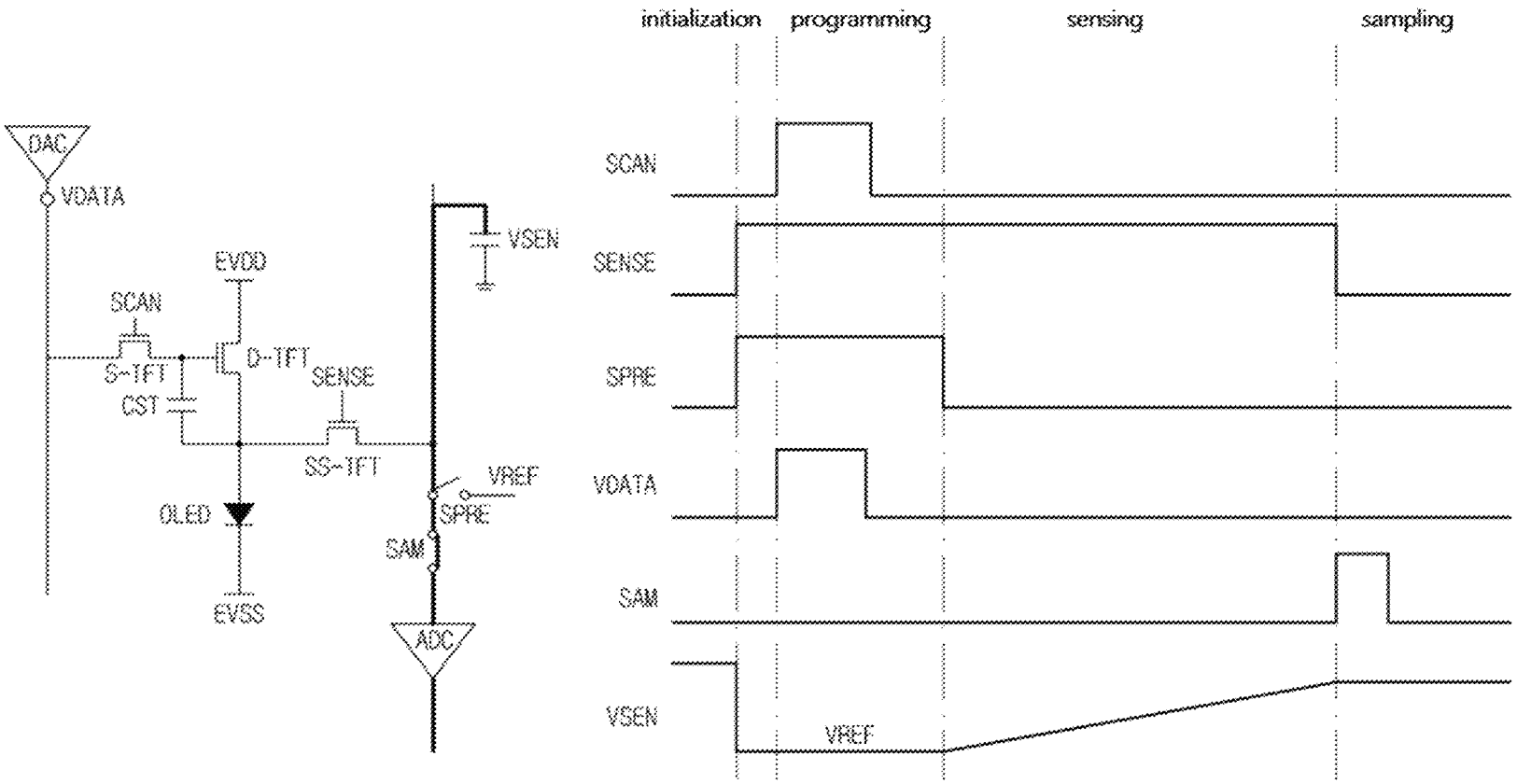

Referring to FIG. 4D, in a sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the mobility features of the corresponding driving TFT.

FIGS. 5A to 5E are views for describing compensation for the mobility feature while the display device is driven. That is, the compensation in the present description is performed while the display device is powered on and the image data is being output. Also, the compensation in the present description corresponds to compensation for correcting the deviation by sensing the mobility feature of the driving TFT.

The sensing of the mobility features during the driving of the display device may be performed in a blank period between one frame and the next frame. Also, since four subpixels share one reference line, it is preferable that the sensing of the four subpixels is not simultaneously performed. Also, it is preferable that subpixels having one color among the subpixels connected to a certain gate line are sensed in a blank period and subpixels having other colors among the subpixels connected to the gate line are sensed in the next blank period. This is because all the subpixels connected to the gate line may not be sensed since the blank period is short.

Figure 5A:
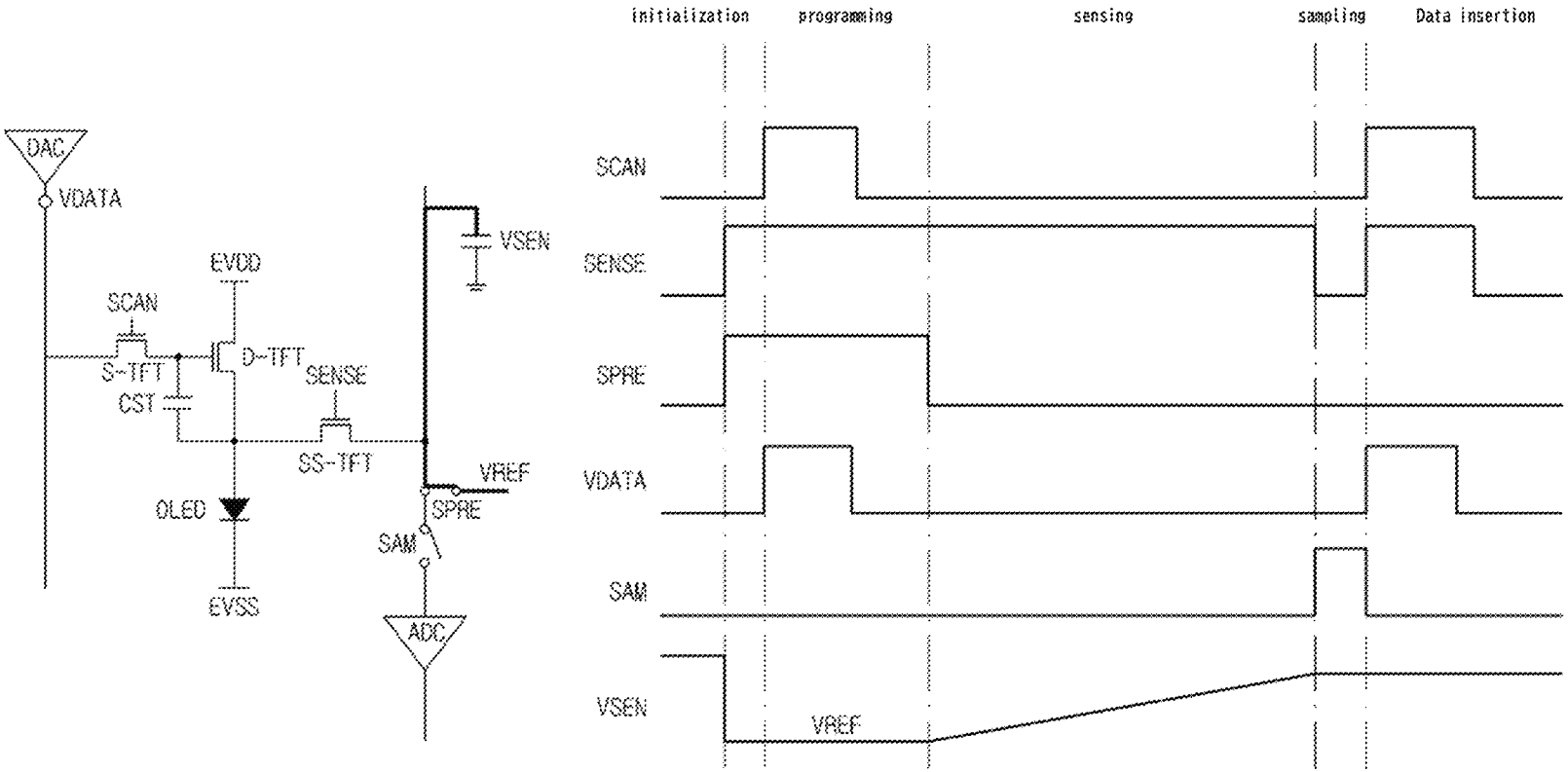
FIGS. 5A to 5E are views for describing compensation for the mobility feature while the display device is driven.

Referring to FIG. 5A, the switch SPRE is turned on in the initialization period. Accordingly, the sensing voltage VSEN stored in the capacitor of the reference line is equal to the reference voltage VREF.

Figure 5B:
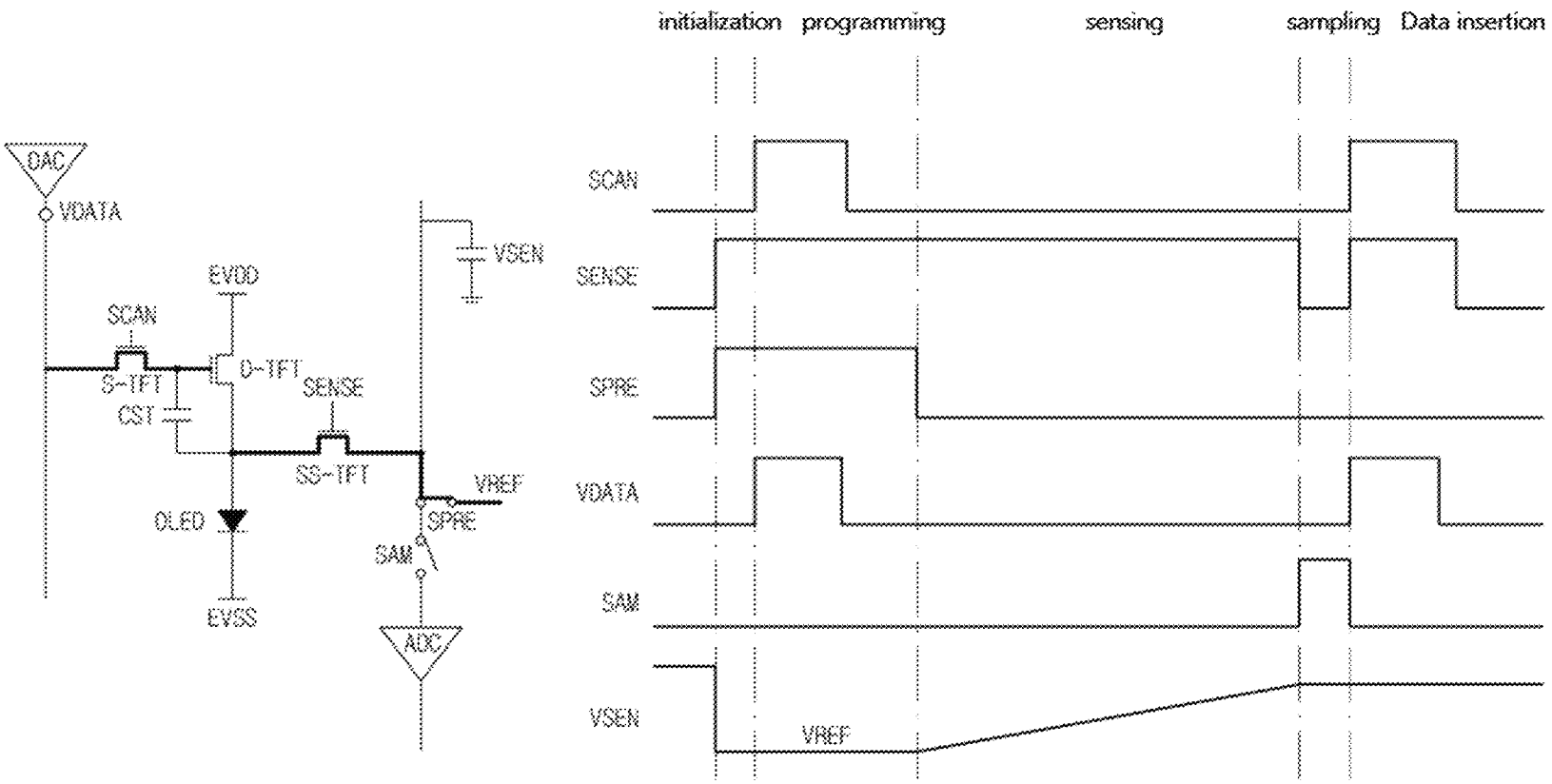

Referring to FIG. 5B, the scan TFT (S-TFT) is turned on in a programming period. Also, the data voltage VDATA is a high voltage. Accordingly, a charge corresponding to the data voltage VDATA is charged at one end of the storage capacitor CST. Also, in the programming period, the sensing TFT (SS-TFT) is turned on and the switch SPRE is turned on. Accordingly, the other end of the storage capacitor CST is charged with a charge corresponding to the reference voltage VREF. That is, the voltage across the storage capacitor CST corresponds to a difference between the data voltage VDATA and the reference voltage VREF. Meanwhile, since the switch SPRE is maintained to be turned on, the sensing voltage VSEN is maintained as the reference voltage VREF.

Figure 5C:
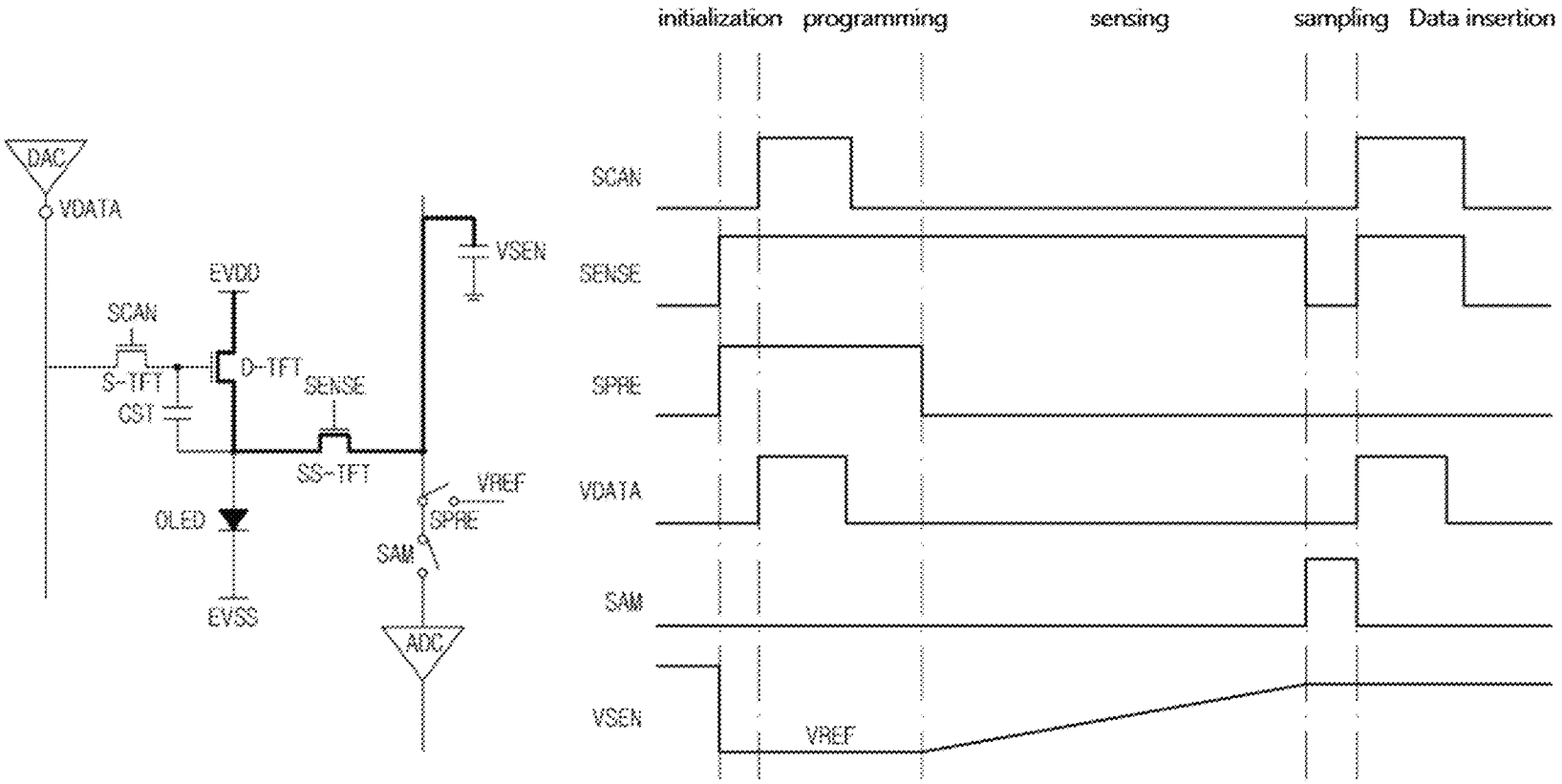

Referring to FIG. 5C, in the sensing period, the scan TFT (S-TFT) is turned off and the sensing TFT (SS-TFT) is turned on. Accordingly, the driving TFT (D-TFT) operates like a constant current source with a constant magnitude, and the current is applied to the reference capacitor through the sensing TFT (SS-TFT). Accordingly, the sensing voltage VSEN increases with a constant voltage increase over time.

Figure 5D:
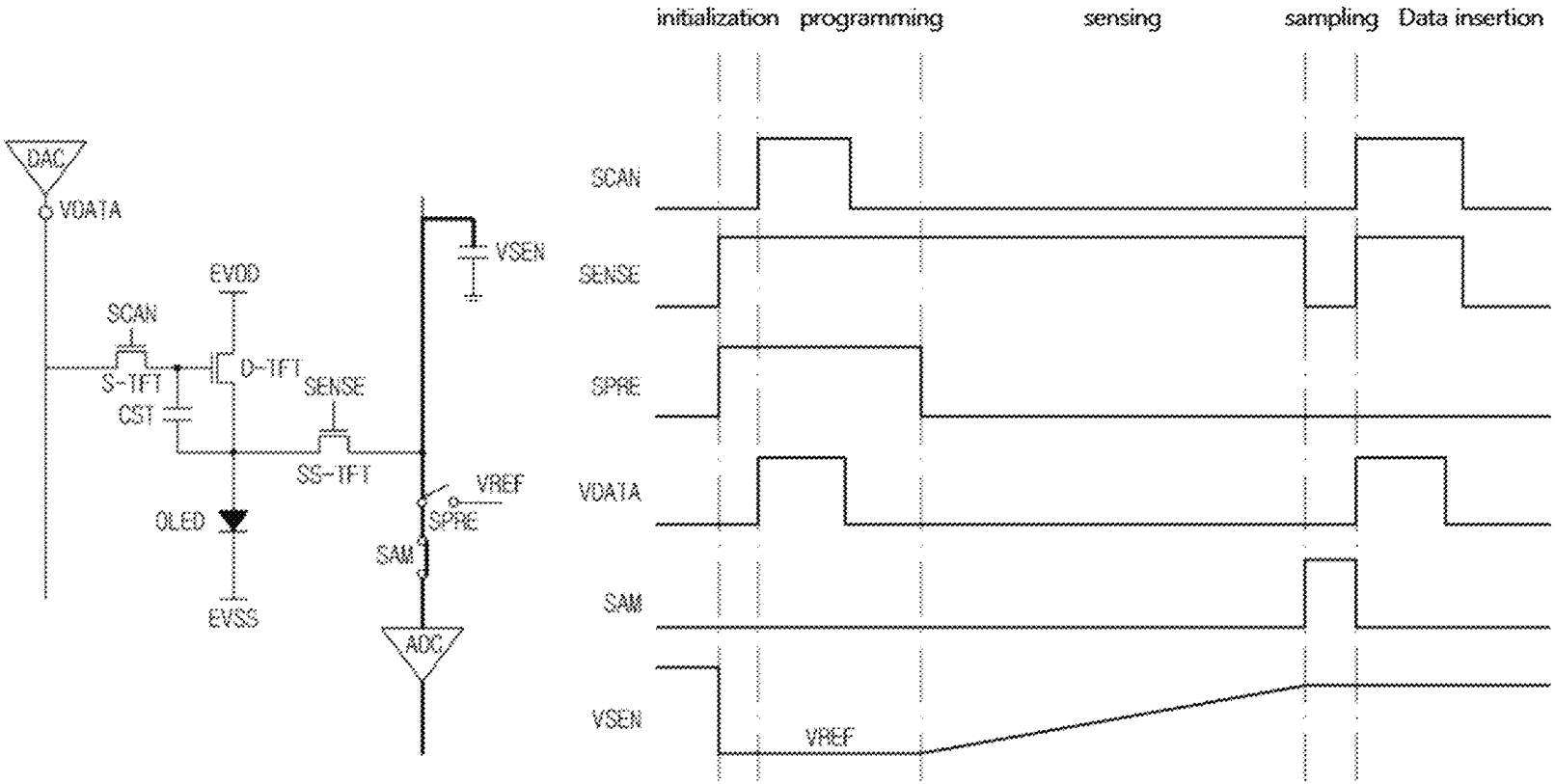

Referring to FIG. 5D, in the sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the mobility features of the corresponding driving TFT.

Figure 5E:
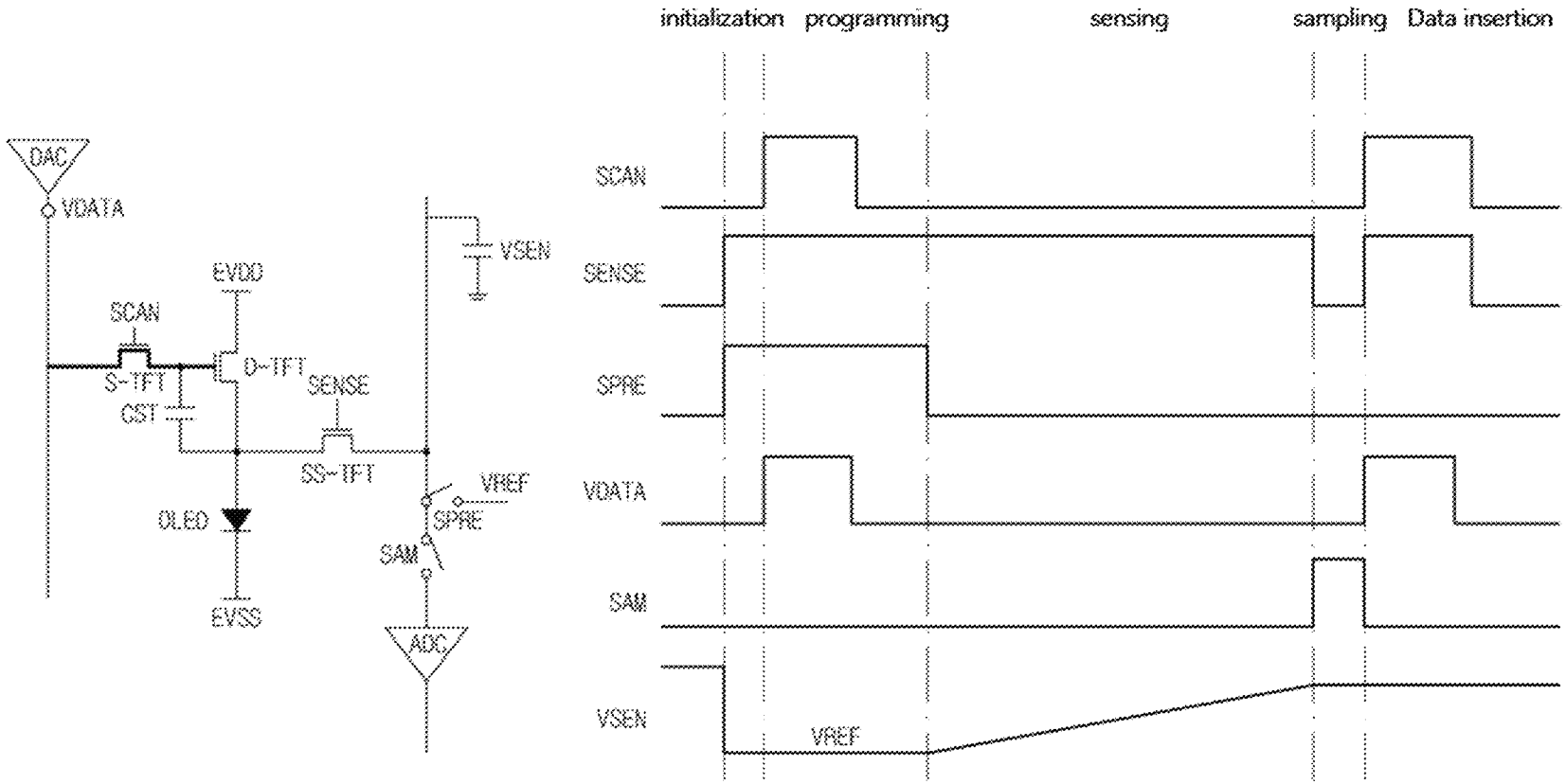

Meanwhile, referring to FIG. 5E, in a data insertion period after the sampling period, the scan TFT (S-TFT) is turned on and the data voltage VDATA is a high voltage. That is, since a real-time compensation is performed, the process of FIGS. 5A to 5D is performed during the blank period between frame and frame. A luminance deviation from another data line charged with an existing data voltage occurs. In order to correct the luminance deviation, the data of the previous frame is restored after the sampling period.

FIGS. 6A to 6D are views for describing compensation for a threshold voltage characteristic after the display device is powered off. That is, the compensation in the present description is performed while the display device is powered off and the image data is not output. Also, the compensation in the present description corresponds to compensation for correcting the deviation by sensing the threshold voltage characteristic of the driving TFT.

The sensing of the threshold voltage characteristic after the display device is powered off may be performed in a state in which the power of the display device is not turned off and a black screen is displayed even though a user has turned off the display device. Since the four subpixels share one reference line, it is preferable that the sensing of the four subpixels is not simultaneously performed. Therefore, it is preferable that subpixels having one color among the subpixels connected to a certain gate line are sensed and subsequently subpixels having other colors are sensed and all the subpixels of the corresponding gate line are sensed and then sensing of the next gate line is performed. This is because, unlike real-time sensing, this case is free from time constraints.

Figure 6A:
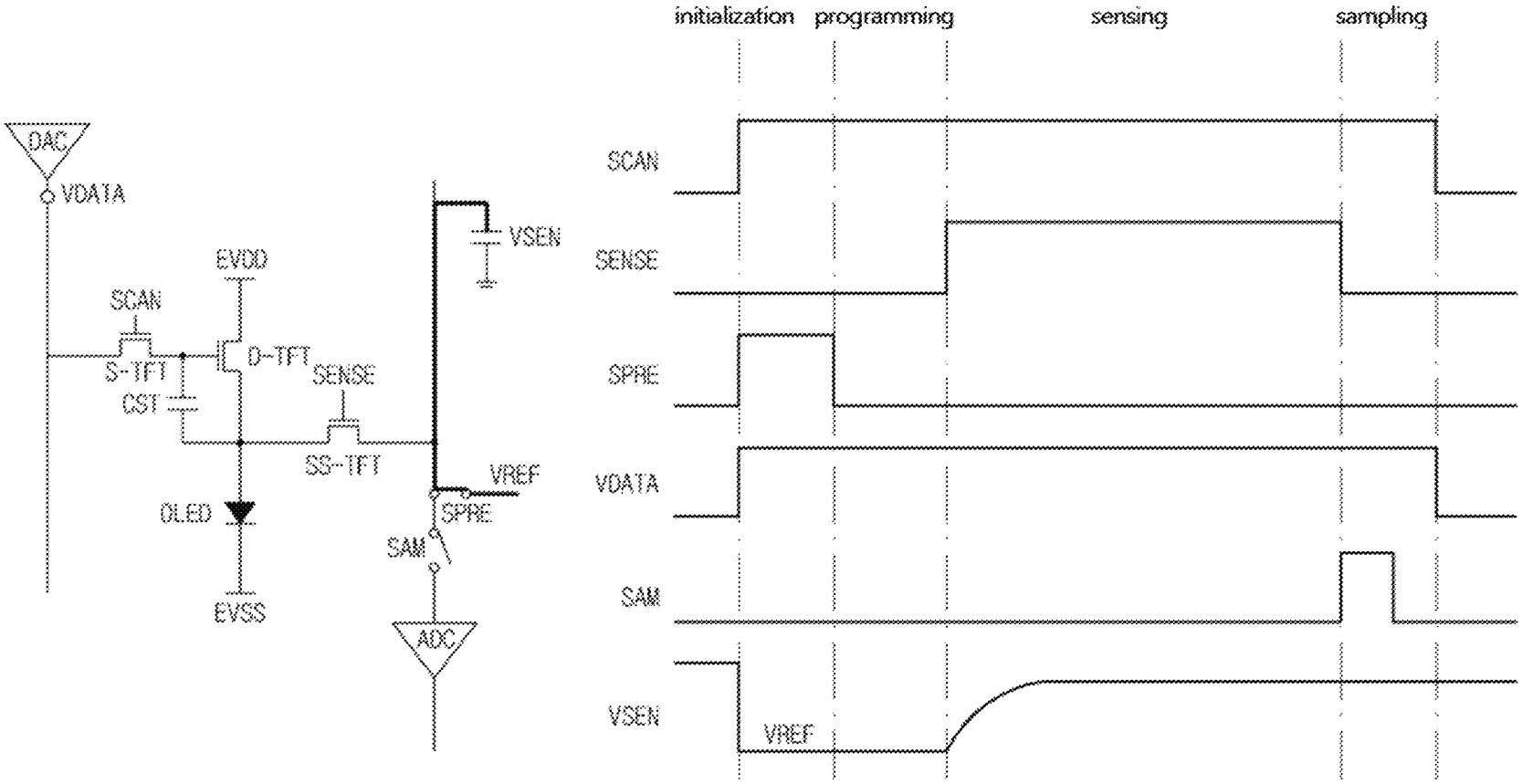
FIGS. 6A to 6D are views for describing compensation for a threshold voltage characteristic after the display device is powered off.

Referring to FIG. 6A, the switch SPRE is turned on in the initialization period. Accordingly, the sensing voltage VSEN stored in the capacitor of the reference line is equal to the reference voltage VREF.

Figure 6B:
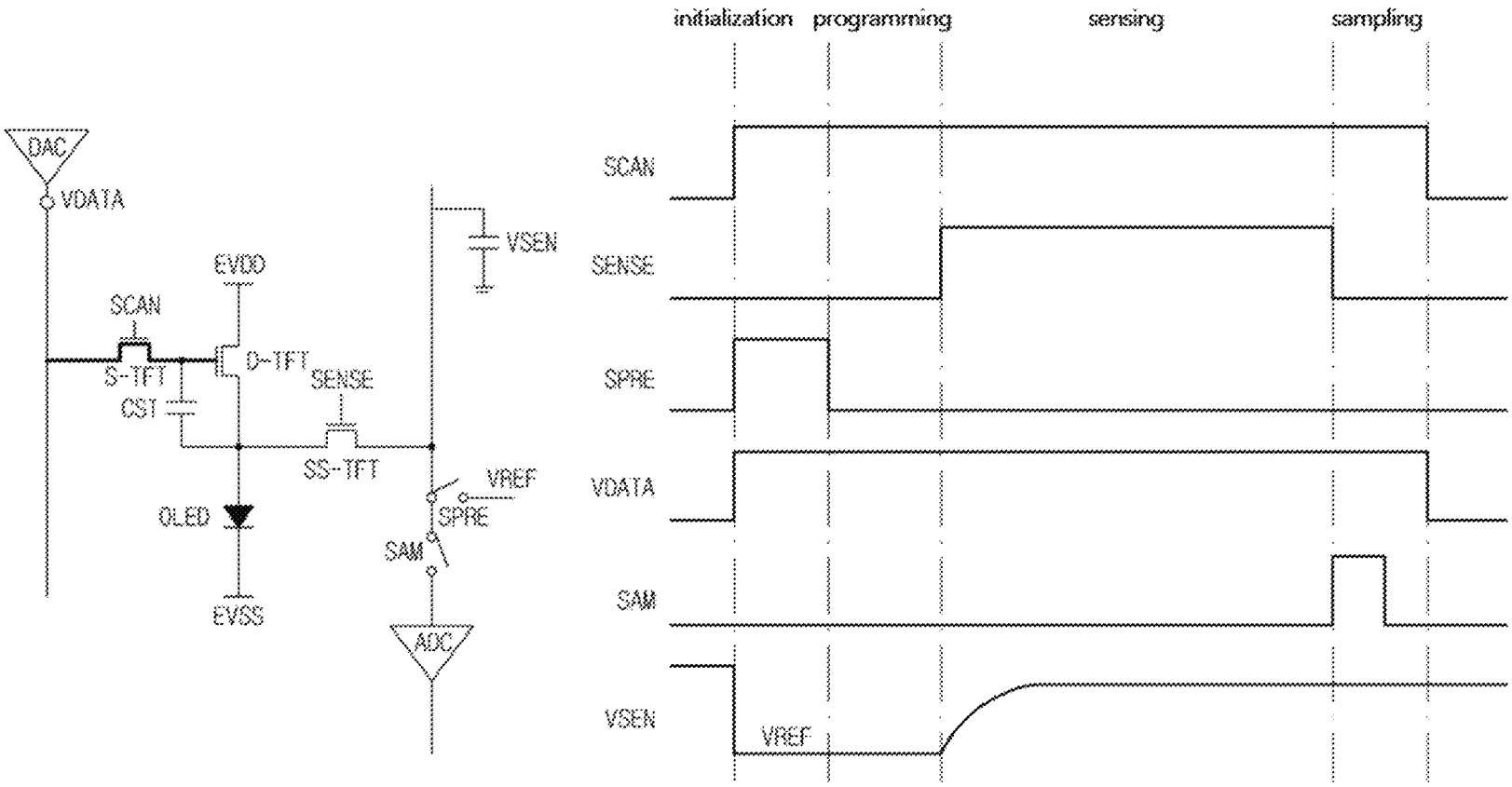

Referring to FIG. 6B, the scan TFT (S-TFT) is turned on in a programming period. Also, the data voltage VDATA is a high voltage. Accordingly, a charge corresponding to the data voltage VDATA is charged at one end of the storage capacitor CST. Also, the other end of the storage capacitor CST is floating. Therefore, due to the capacitor characteristics, the voltage at the other end of the storage capacitor CST increases at the same rate as that at which the voltage at one end of the storage capacitor CST increases.

Figure 6C:
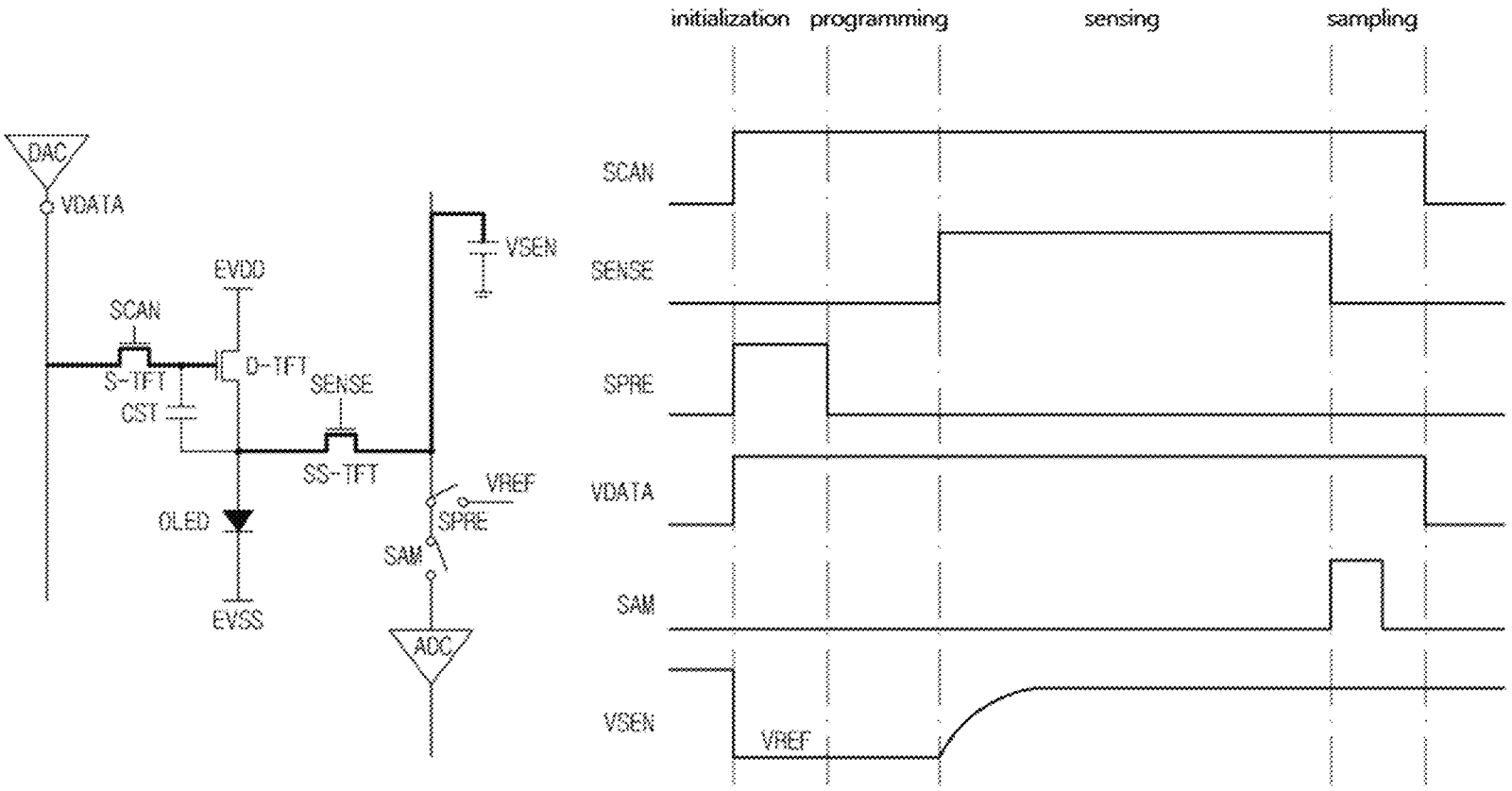

Referring to FIG. 6C, in the sensing period, the scan TFT (S-TFT) is maintained to be turned on and the data voltage VDATA is maintained high. Accordingly, a charge corresponding to the data voltage VDATA is continuously charged at one end of the storage capacitor CST. In the sensing period, the sensing TFT (SS-TFT) is turned on. Accordingly, the sensing voltage VSEN increases in the same way as that in which the voltage at the other end of the storage capacitor CST increases.

Figure 6D:
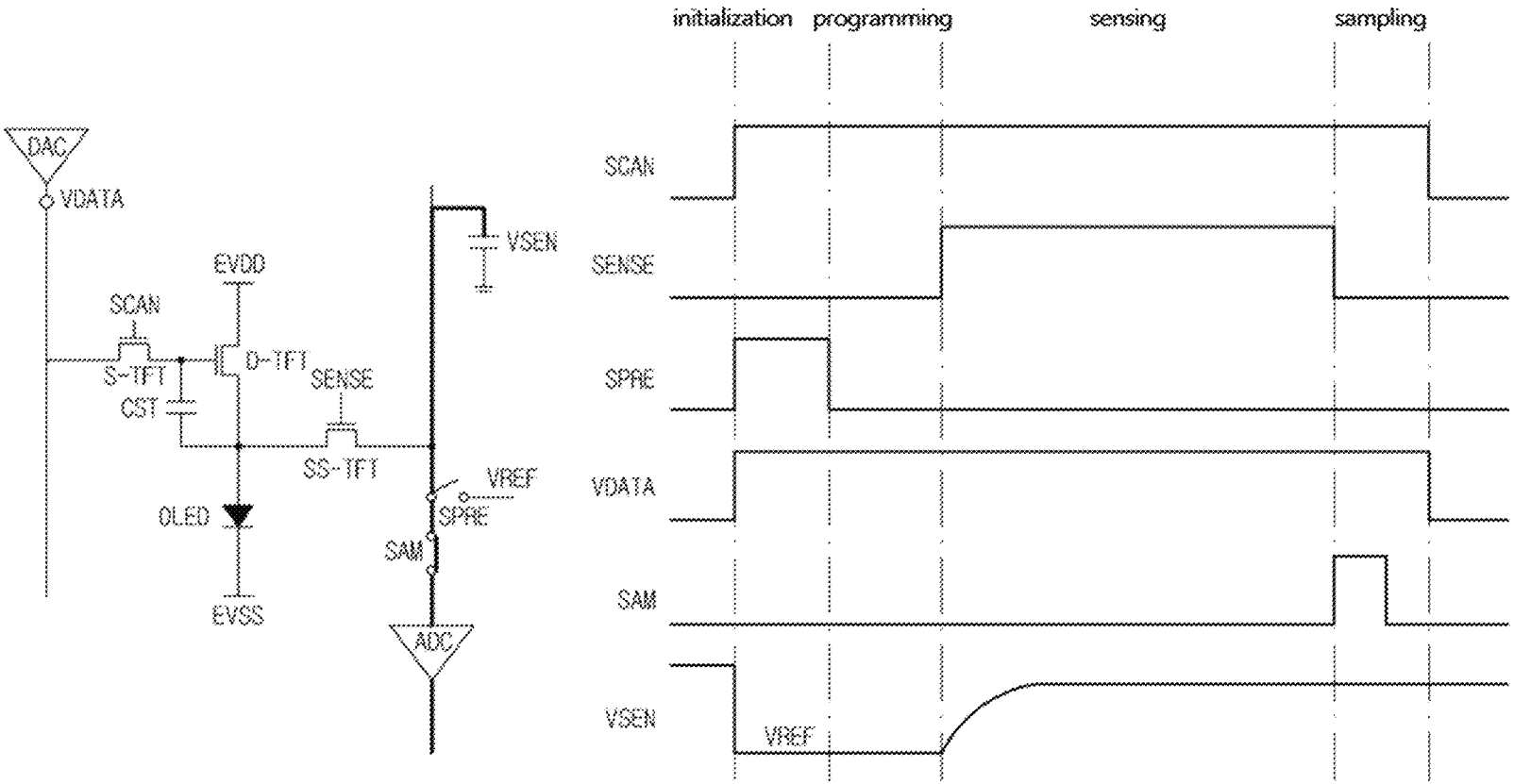

Referring to FIG. 6D, in the sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the threshold voltage characteristic of the corresponding driving TFT.

FIGS. 7A to 7E are views for describing sensing of degradation of an organic light emitting device (OLED). Each of the subpixels includes the light emitting device (OLED), and the degree of degradation is different for each light emitting device (OLED). Accordingly, the quality of the display image can be made uniform by sensing and compensating for the degradation of each light emitting device (OLED).

Figure 7A:
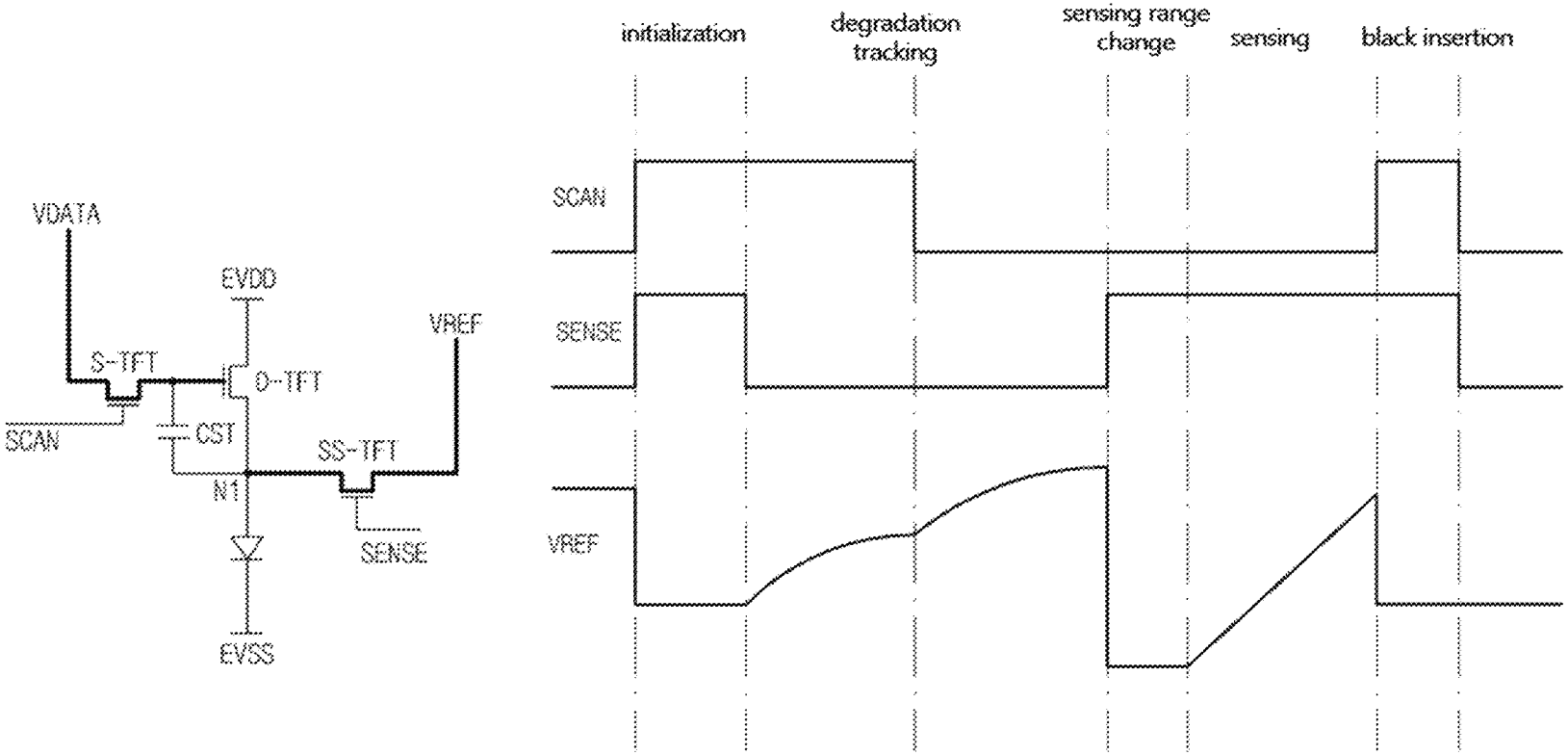
FIGS. 7A to 7E are views for describing sensing of degradation of an organic light emitting device (OLED)

Referring to FIG. 7A, in the initialization period, the scan TFT (S-TFT) is turned on and the sensing TFT (SS-TFT) is turned on. Accordingly, VDATA is charged in one end of the storage capacitor CST, and a node N1, that is the other end of the storage capacitor CST, is initialized to VREF.

Figure 7B:
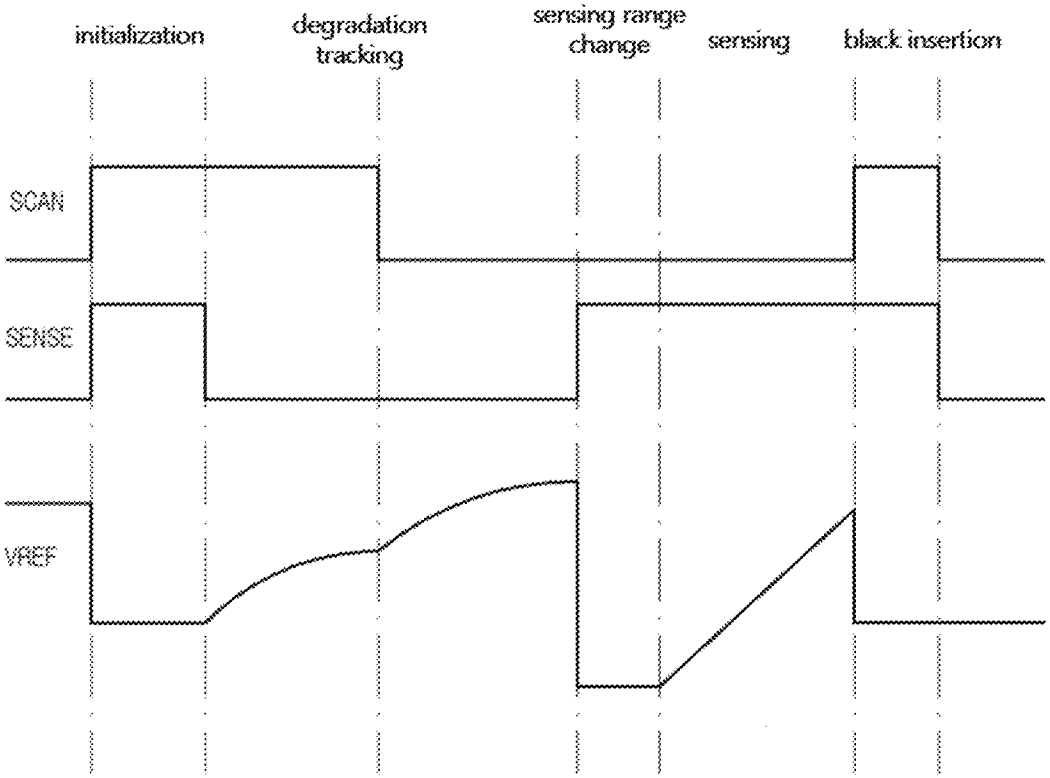
Figure 7B:
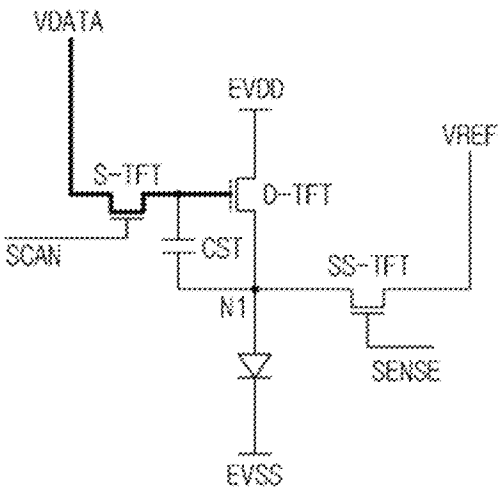

Referring to FIG. 7B, in a degradation tracking period, the scan TFT (S-TFT) is maintained to be turned on and the sensing TFT (SS-TFT) is turned off. While VDATA is maintained in one end of the storage capacitor CST, the other end (N1) is floating, so that the voltage of the node N1 increases. Then, the scan TFT (S-TFT) is turned off and thereby the other end of the storage capacitor CST is boosted. That is, the voltage of the node N1 increases once more.

Figure 7C:
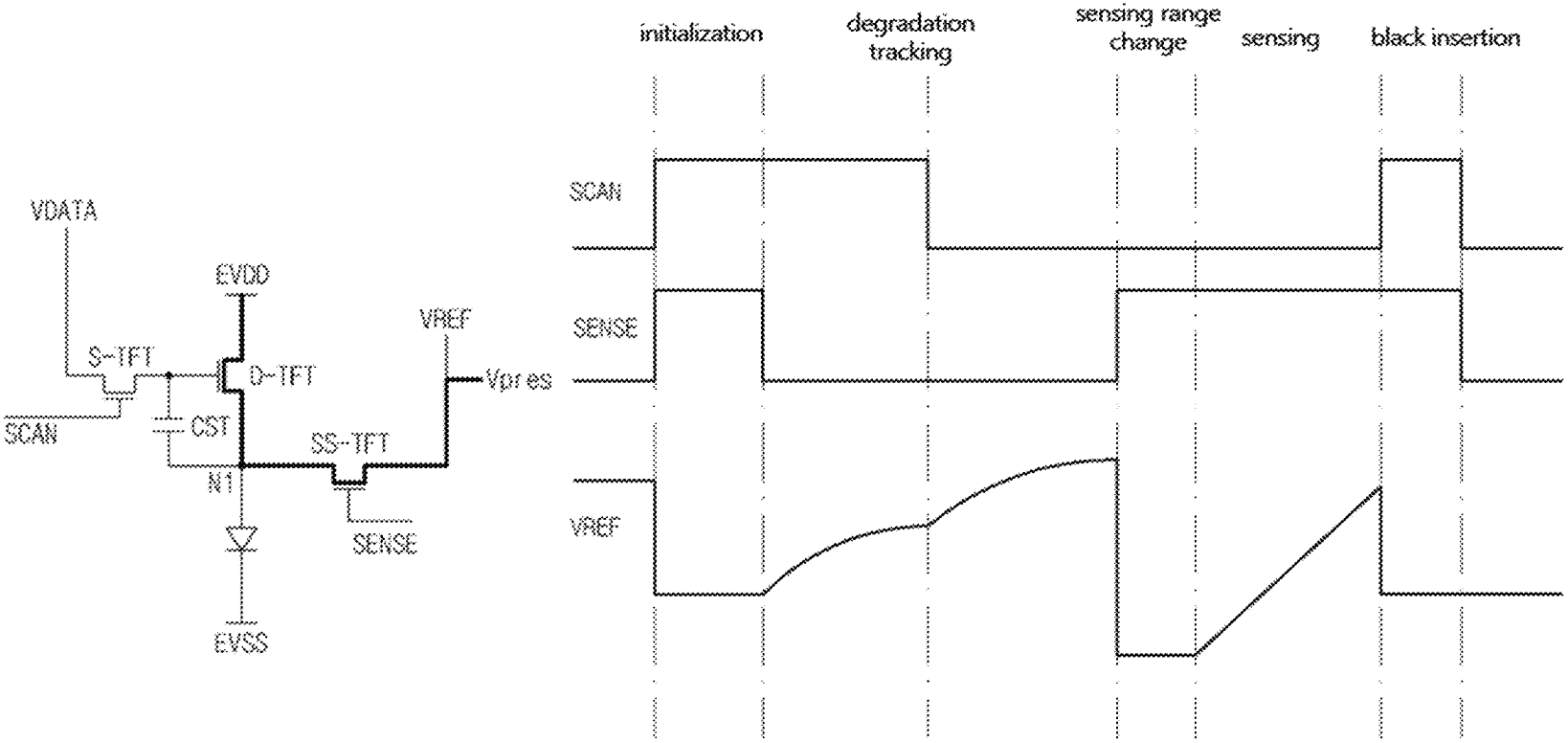

Referring to FIG. 7C, in a sensing range change period, the sensing TFT (SS-TFT) is turned on and is connected to a voltage Vpres. Accordingly, the voltage of the node N1 decreases to the Vpres. That is, in the sensing range change period, the voltage of the node N1 is decreased to a sensing range of the source driving IC (S-IC).

Figure 7D:
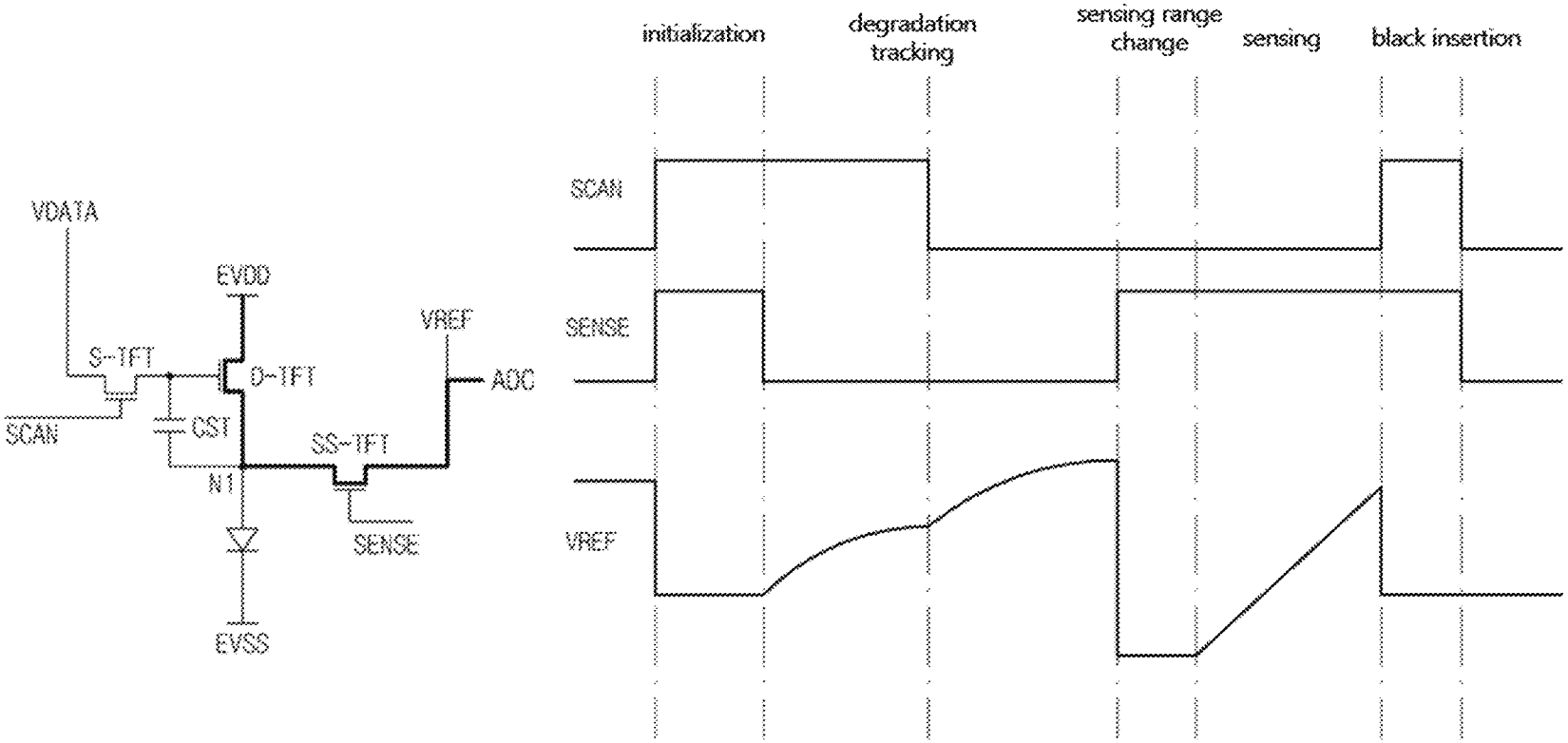

Referring to FIG. 7D, in the sensing period, the scan TFT (S-TFT) is turned off and the sensing TFT (SS-TFT) is turned on. Since the voltage across the storage capacitor CST is formed in the previous period, the driving TFT (D-TFT) operates like a constant current source with a constant magnitude, and the current passes through the sensing TFT (SS-TFT) and flows to the reference line. Here, the voltage of the node N1 increases with a constant voltage increase over time. Then, when a sampling switch connected to the reference line is turned on, the sensed voltage is applied to the source driving IC (S-IC) through the ADC.

Figure 7E:
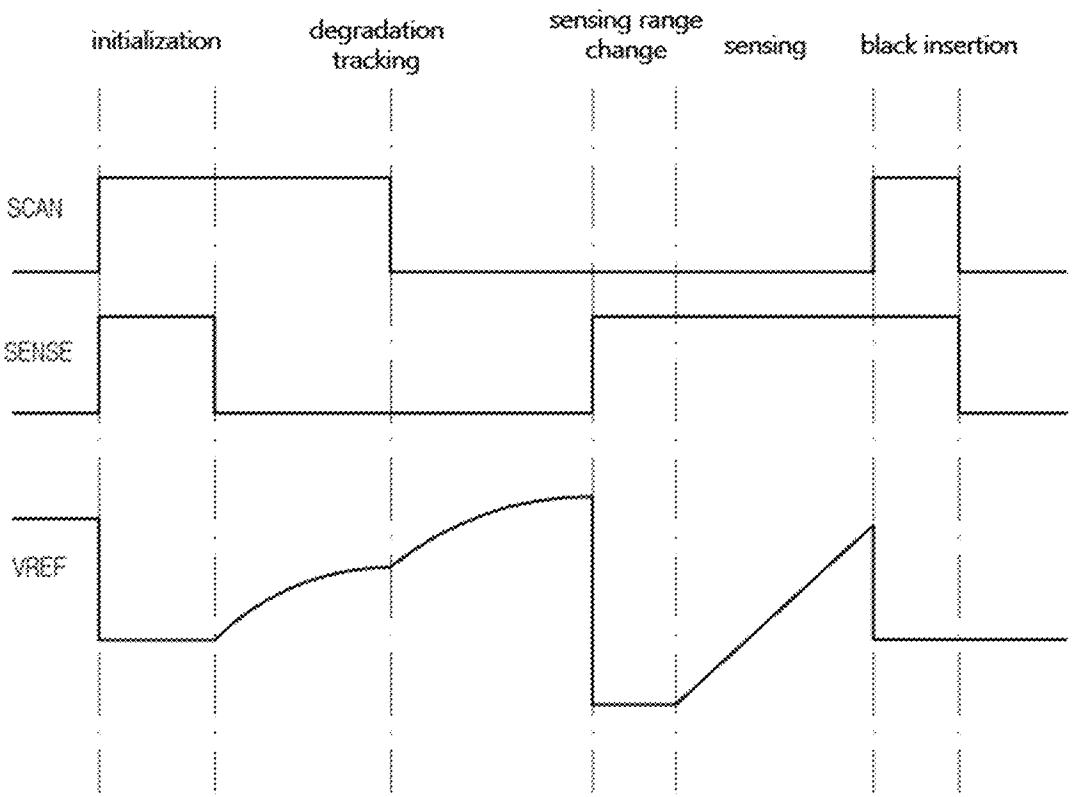
Figure 7E:
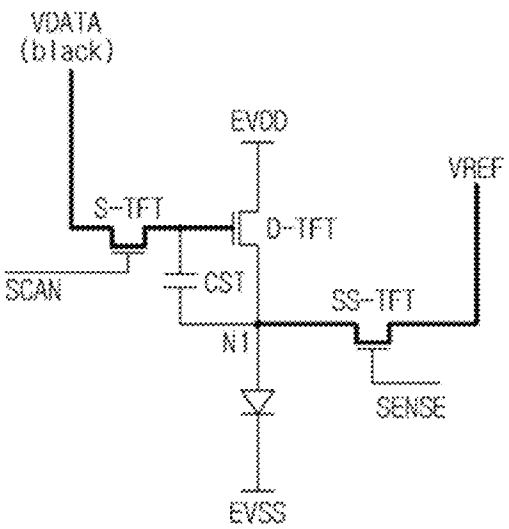

Referring to FIG. 7E, in a black insertion period, the scan TFT (S-TFT) is turned on and the sensing TFT (SS-TFT) is turned on. In this case, the voltage VDATA applied to the data line is a voltage indicating black.

Figure 8A:
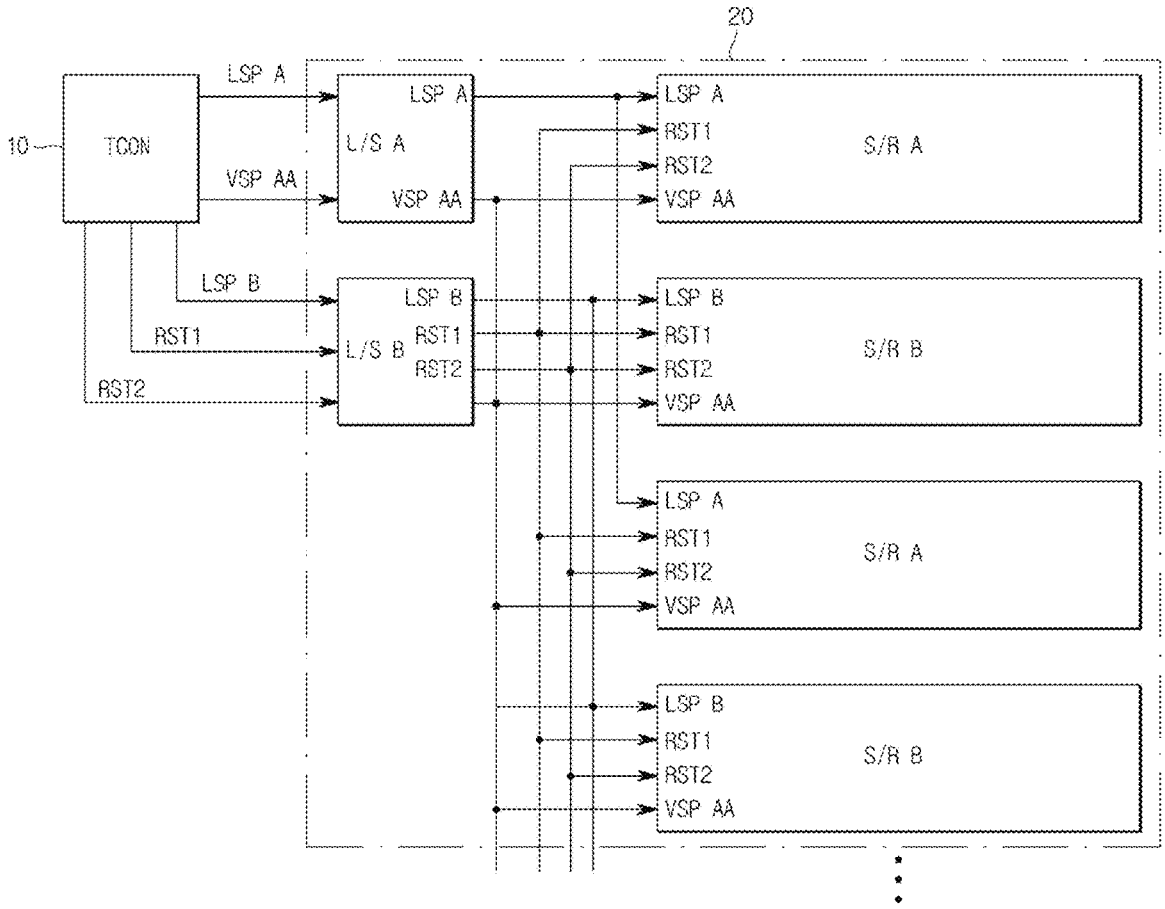
FIGS. 8A and 8B are views showing a gate driver 20 according to the embodiment of the present disclosure.
Figure 8B:
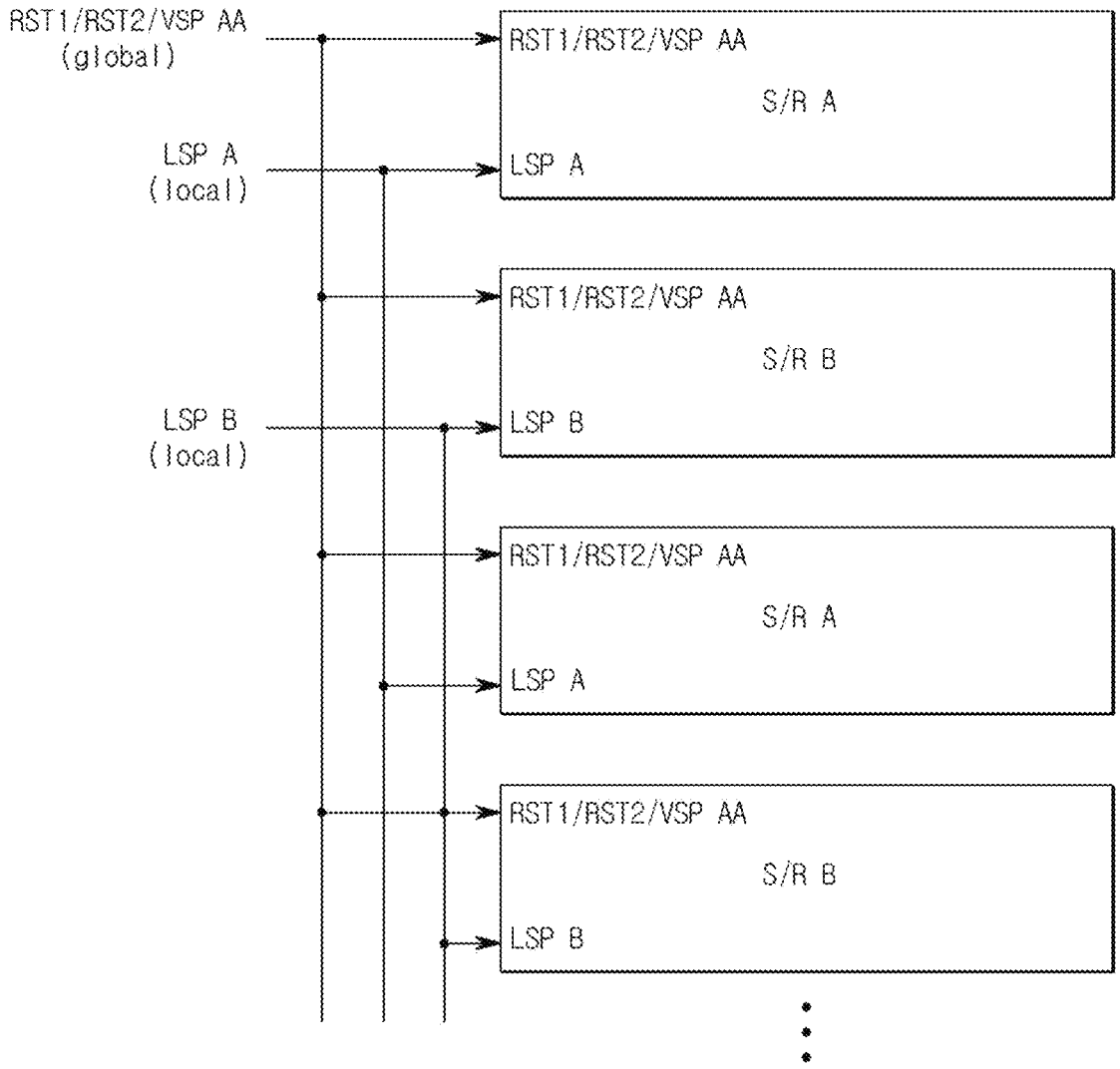

FIGS. 8A and 8B are views showing the gate driver 20 according to the embodiment of the present disclosure.

Prior to the detailed description, some components will be described first. An M node is a node within the shift register. The M node is for selecting a gate line to be sensed. For example, when the specific M node within the shift register is charged with a carry, a gate line connected to the M node is determined as a gate line to be sensed. A Q node is a node within the shift register. The Q node receives carry from the M node. When the Q node is in a high state (i.e., while having a carry), an output signal of the gate driver is output by synchronizing with the clock signal.

A global way is a way in which different kinds of shift register operates by one signal. For example, in FIG. 8B, the RST1 signal is a global signal. When the RST1 signal is input, the RST1 signal is applied to both S/R-A and S/R-B, and both S/R-A and S/R-B perform an operation corresponding to the RST1 signal accordingly. A local way is a way in which one kind of shift register operates by one signal. For example, in FIG. 8B, the LSP A is a local signal. When the LSP A signal is input, the LSP A signal is applied to only S/R-A, and S/R-A performs an operation corresponding to the LSP A signal accordingly. Contrary to this, the LSP A signal is not applied to S/R-B. Therefore, S/R-B does not perform an operation corresponding to the LSP B signal.

Referring to FIG. 8A, the gate driver 20 according to the embodiment includes a level shifter A (L/S A), a level shifter B (L/S B), a plurality of shift registers (S/R A) associated with the level shifter A (L/S A), and a plurality of shift registers (S/R B) associated with the level shifter B (L/S B).

An LSP A signal charges a node M within the shift register A. That is, when the shift register A receives the LSP A signal, the node M is charged. Such an LSP A signal may be applied to the shift register A while the black screen is displayed on the display panel.

An LSP B signal charges a node M within the shift register B. That is, when the shift register B receives the LSP B signal, the node M is charged. Such an LSP B signal may be applied to the shift register B while the black screen is displayed on the display panel.

An RST1 signal moves a carry charged in the node M within the shift register A or the shift register B to a node Q. That is, when the shift register A receives the RST1 signal, the shift register A moves the carry charged in the node M to the node Q. Also, when the shift register B receives the RST1 signal, the shift register B moves the carry charged in the node M to the node Q. Such an RST1 signal may be applied to the shift register A or the shift register B before the sensing of the subpixel is started.

An RST2 signal discharges the carry charged in the node Q within the shift register A or the shift register B. That is, when the shift register A receives the RST2 signal, the carry charged in the node Q is discharged. Also, when the shift register B receives the RST2 signal, the carry charged in the node Q is discharged. Such an RST2 signal may be applied to the shift register A or the shift register B after the sensing of the subpixel is finished.

A VSP AA signal discharges forcibly the carry charged in the node Q within the shift register A and the shift register B.

Referring to FIG. 8B, the RST1, RST2 and VSP AA signals are simultaneously applied to the shift register A and the shift register B. That is, the RST1, RST2 and VSP AA signals are connected to the shift registers AB in a global way.

Meanwhile, the LSP A signal is simultaneously applied to the shift registers A and is not applied to the shift registers B. That is, the LSP A signal is connected to the shift register A in a local way.

Also, the LSP B signal is simultaneously applied to the shift registers B and is not applied to the shift registers A. That is, the LSP B signal is connected to the shift register B in a local way.

Figure 9A:
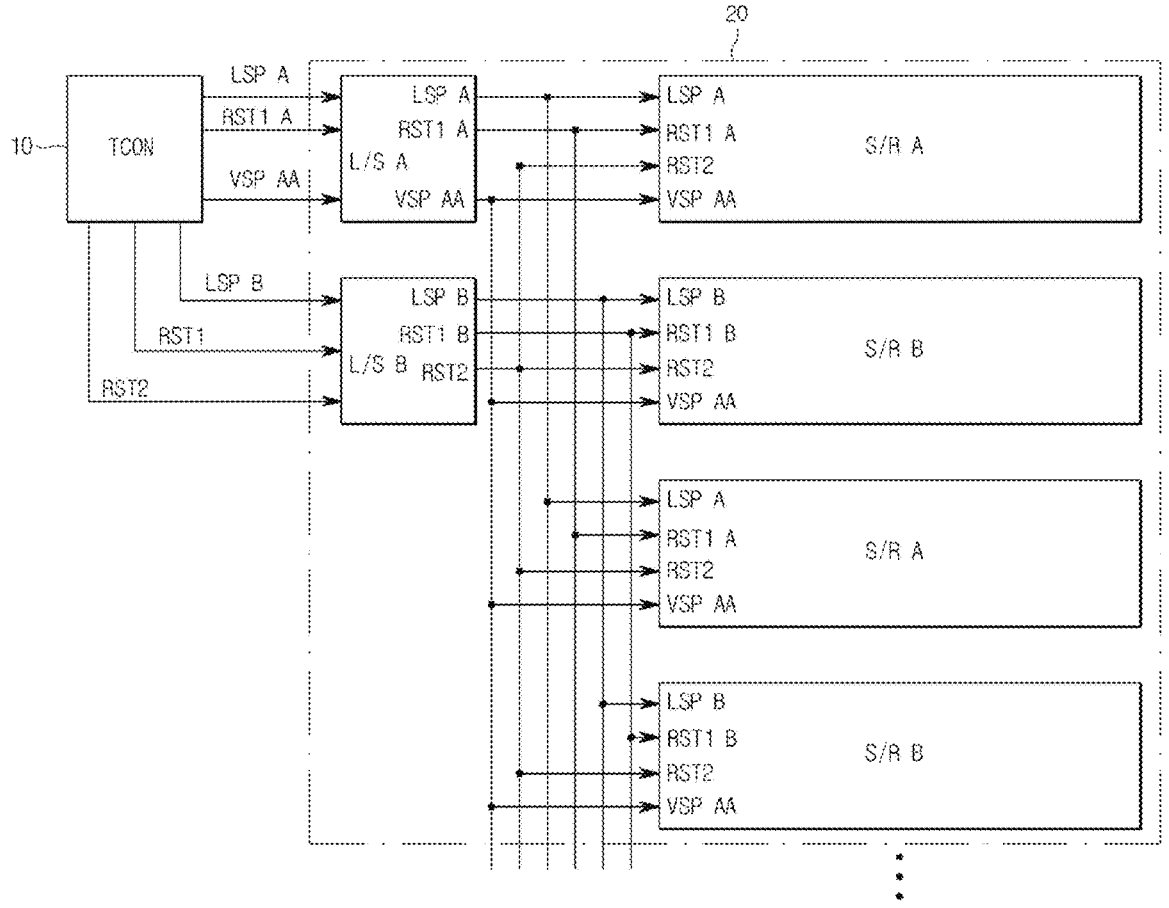
FIGS. 9A and 9B are views showing the gate driver 20 according to another embodiment of the present disclosure.
Figure 9B:
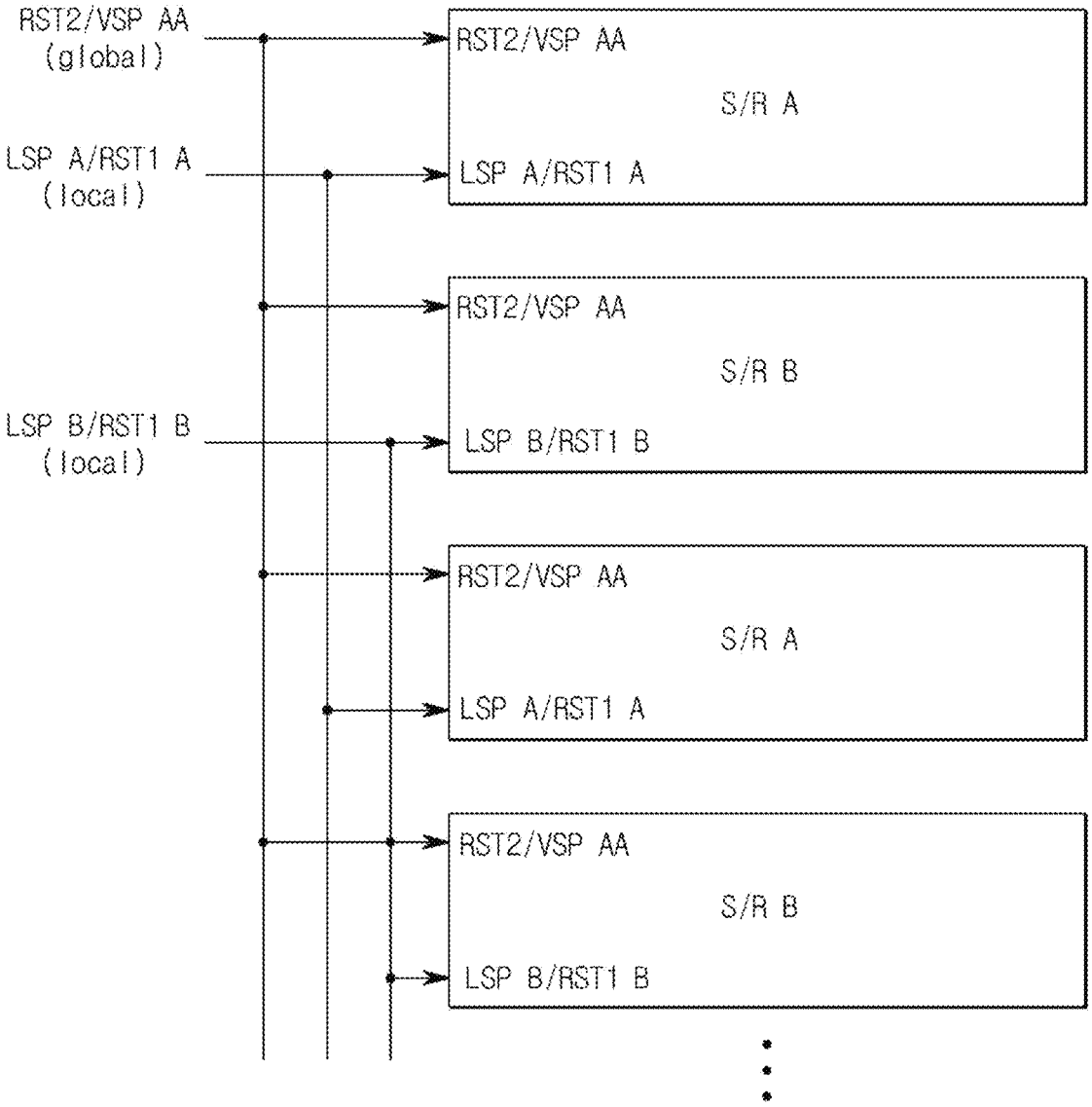

FIGS. 9A and 9B are views showing the gate driver 20 according to another embodiment of the present disclosure.

Referring to FIG. 9A, the gate driver 20 according to the embodiment includes a level shifter A (L/S A), a level shifter B (L/S B), a plurality of shift registers (S/R A) associated with the level shifter A (L/S A), and a plurality of shift registers (S/R B) associated with the level shifter B (L/S B).

An LSP A signal charges a node M within the shift register A. That is, when the shift register A receives the LSP A signal, the node M is charged. Such an LSP A signal may be applied to the shift register A while the black screen is displayed on the display panel.

An LSP B signal charges a node M within the shift register B. That is, when the shift register B receives the LSP B signal, the node M is charged. Such an LSP B signal may be applied to the shift register B while the black screen is displayed on the display panel.

An RST1 signal moves a carry charged in the node M within the shift register A or the shift register B to a node Q. That is, when the shift register A receives the RST1 signal, the shift register A moves the carry charged in the node M to the node Q. Also, when the shift register B receives the RST1 signal, the shift register B moves the carry charged in the node M to the node Q. Such an RST1 signal may be applied to the shift register A or the shift register B before the sensing of the subpixel is started.

An RST2 signal discharges the carry charged in the node Q within the shift register A or the shift register B. That is, when the shift register A receives the RST2 signal, the carry charged in the node Q is discharged. Also, when the shift register B receives the RST2 signal, the carry charged in the node Q is discharged. Such an RST2 signal may be applied to the shift register A or the shift register B after the sensing of the subpixel is finished.

A VSP AA signal discharges forcibly the carry charged in the node Q within the shift register A and the shift register B.

Referring to FIG. 9B, the RST2 and VSP AA signals are simultaneously applied to the shift register A and the shift register B. That is, the RST2 and VSP AA signals are connected to the shift registers AB in a global way.

Meanwhile, an RST1 A signal and the LSP A signal are simultaneously applied to the shift registers A and are not applied to the shift registers B. That is, the RST1 A signal and the LSP A signal are connected to the shift register A in a local way.

Also, an RST1 B signal and the LSP B signal are simultaneously applied to the shift registers B and are not applied to the shift registers A. That is, the RST1 B signal and the LSP B signal are connected to the shift register B in a local way.

FIGS. 10A to 10E are views for describing sensing for compensation according to the embodiment of the present disclosure.

Figure 10A:
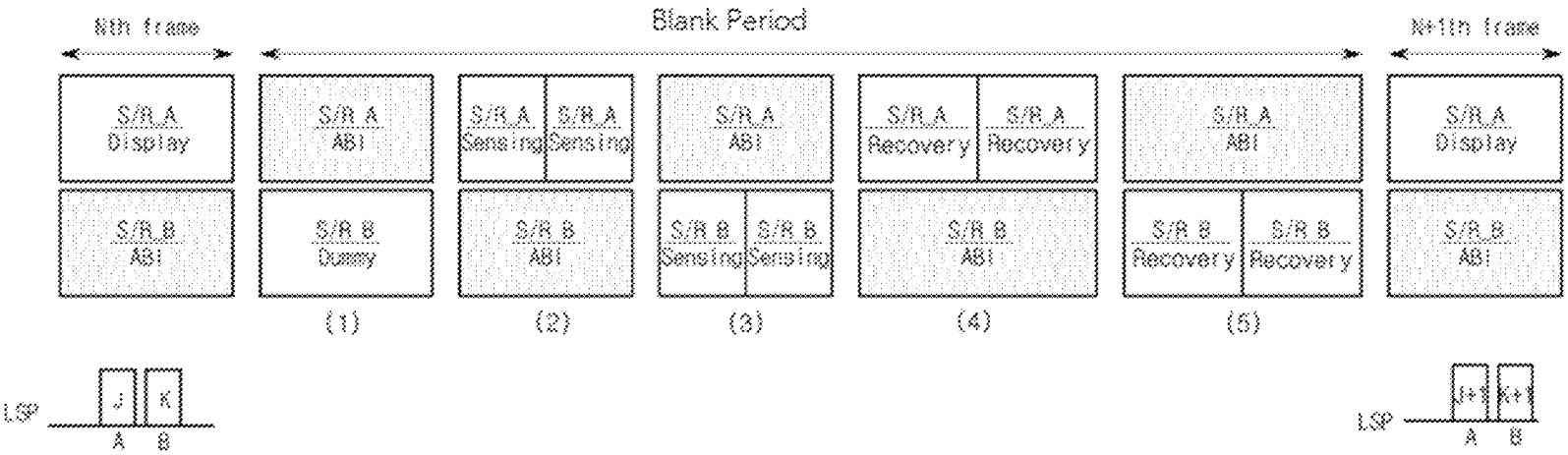
FIGS. 10A to 10E are views for describing sensing for compensation according to the embodiment of the present disclosure.

First, referring to FIG. 10A, the compensation according to the embodiment of the present disclosure is performed in a period between a frame ($N^{th}$ frame) and a frame ($N+1^{th}$ frame). Such a period is referred to as a blank period. In the description of the embodiment, it is assumed that the shift register A is connected to the $J^{th}$ gate line, and the shift register B is connected to the $K^{th}$ gate line.

In an $N^{th}$ frame period, the LSP A and LSP B signals are generated. As described above, the LSP A is received by the shift register A in a local way, and the node M of the shift register A which has received the LSP A signal is charged. Also, the LSP B is received by the shift register B in a local way, and the node M of the shift register B which has received the LSP B signal is charged. Accordingly, a below-described preliminary operation for sensing is performed on the $J^{th}$ gate line and the $K^{th}$ gate line.

In a period (1) of the blank period, the shift register A performs an operation to output black data (ABI). Meanwhile, in the period (1) of the blank period, the shift register B performs a dummy operation (Dummy).

In a period (2) of the blank period, the shift register A performs a sensing operation for compensation (Sensing). In particular, in this period, the shift register A sequentially performs the sensing operation for compensation twice. More specifically, in one sensing operation, the shift register A senses the subpixels having one color among a plurality of subpixels included in the connected gate line (for example, the $J^{th}$ gate line of the display panel may be connected to the shift register A). Subsequently, in the other sensing operation, the shift register A may sense the subpixels having another one color among a plurality of subpixels included in the same gate line. Meanwhile, in the period (2) of the blank period, the shift register B performs an operation for outputting the black data (ABI).

In a period (3) of the blank period, the shift register A performs an operation for outputting the black data (ABI). Meanwhile, in this period, the shift register B performs a sensing operation for compensation (Sensing). In particular, in this period, the shift register B sequentially performs the sensing operation for compensation twice. More specifically, in one sensing operation, the shift register B senses the subpixels having one color among a plurality of subpixels included in the connected gate line (for example, the $K^{th}$ gate line of the display panel may be connected to the shift register B). Subsequently, in the other sensing operation, the shift register B may sense the subpixels having another one color among a plurality of subpixels included in the same gate line.

In a period (4) of the blank period, the shift register A performs an operation for data recovery (Recovery). Specifically, since a real-time compensation is performed in this embodiment, due to compensation during the blank period between frame and frame, a luminance deviation may occur from another data line charged with an existing data voltage. In order to correct the luminance deviation, the data of the previous frame is restored after the sensing. Also, the shift register A performs the data recovery operation twice. Specifically, since the sensing operation for compensation is performed twice in the period (2), the data recovery operation is also performed twice. That is, in one data recovery operation, data of the sensed subpixels having one color among a plurality of subpixels included in the gate line (the $J^{th}$ gate line) are restored. Subsequently, in the other data recovery operation, data of the sensed subpixels having another one color among a plurality of subpixels included in the same gate line (the $J^{th}$ gate line) are restored. Meanwhile, in this period, the shift register B performs an operation for outputting the black data (ABI).

In a period (5) of the blank period, the shift register A performs an operation for outputting the black data (ABI). Meanwhile, in this period, the shift register B performs an operation for data recovery (Recovery). Specifically, since a real-time compensation is performed in this embodiment, due to compensation during the blank period between frame and frame, a luminance deviation may occur from another data line charged with an existing data voltage. In order to correct the luminance deviation, the data of the previous frame is restored after the sensing. Also, the shift register B performs the data recovery operation twice. Specifically, since the sensing operation for compensation is performed twice in the period (3), the data recovery operation is also performed twice. That is, in one data recovery operation, data of the sensed subpixels having one color among a plurality of subpixels included in the gate line (the $K^{th}$ gate line) are restored. Subsequently, in the other data recovery operation, data of the sensed subpixels having another one color among a plurality of subpixels included in the same gate line (the $K^{th}$ gate line) are restored. Meanwhile, in this period, the shift register B performs an operation for outputting the black data (ABI).

In the $N+1^{th}$ frame period, the LSP A and LSP B signals are generated. As described above, the LSP A is received by the shift register A in a local way, and the node M of the shift register A which has received the LSP A signal is charged. Also, the LSP B is received by the shift register B in a local way, and the node M of the shift register B which has received the LSP B signal is charged. Accordingly, a preliminary operation for sensing is performed on the $J+1^{th}$ gate line and the $K+1^{th}$ gate line in the next blank period.

According to embodiment of the present disclosure, sensing of a total of two lines (the $J^{th}$ gate line and the $K^{th}$ gate line) may be performed in one blank period. Specifically, after the sensing of the $J^{th}$ gate line is terminated in one blank period, sensing of the $K^{th}$ gate line is performed. Also, sensing is performed twice for each line, and compensation is performed for each of the subpixels having one color. As a result, compared to the compensation when the image is generally driven, quadruple compensation can be performed.

Figure 10B:
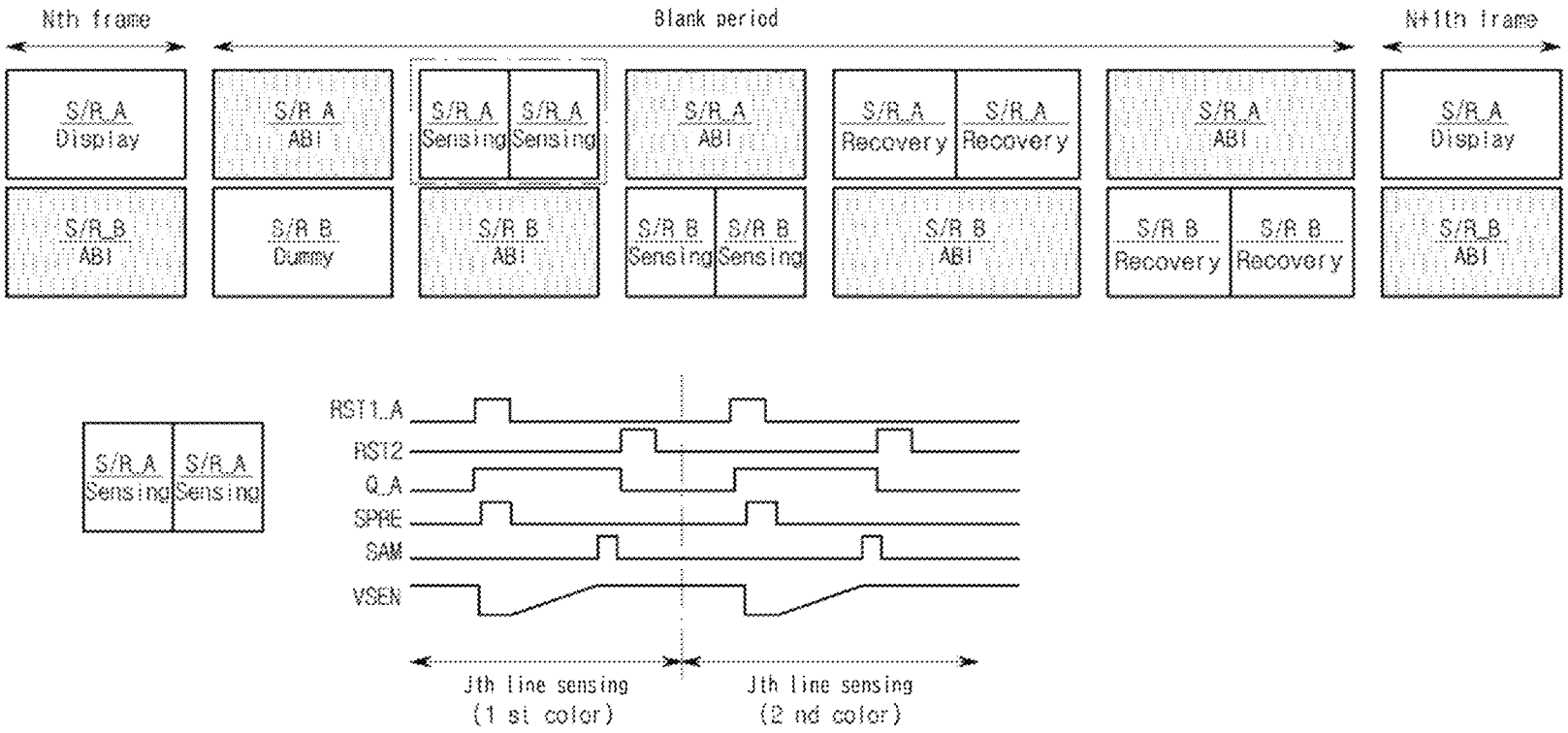

Referring to FIG. 10B, it is shown that the sensing operation is performed twice by the shift register A. Specifically, the shift register A receives the RST1 A signal in a local way. Here, the carry charged in the node M in the $N^{th}$ frame period moves to the node Q. Then, the shift register A receives the RST2 signal in a global way. Here, the carry charged in the node Q is discharged. While the carry is charged in the node Q, sensing is performed on the subpixels having one color among the subpixels included in the $J^{th}$ gate line to which the shift register A is connected. Subsequently, the shift register A receives the RST1 A signal again in a local way, and thus, the carry charged in the node M moves to the node Q. Also, the shift register A receives the RST2 signal in a global way, and thus, the carry charged in the node Q is discharged. While the carry is charged in the node Q, sensing is performed on the subpixels having another one color among the subpixels included in the $J^{th}$ gate line to which the shift register A is connected. That is, in this period, the sensing is performed twice in total, and compensation is performed for each of the subpixels having one color.

Figure 10C:
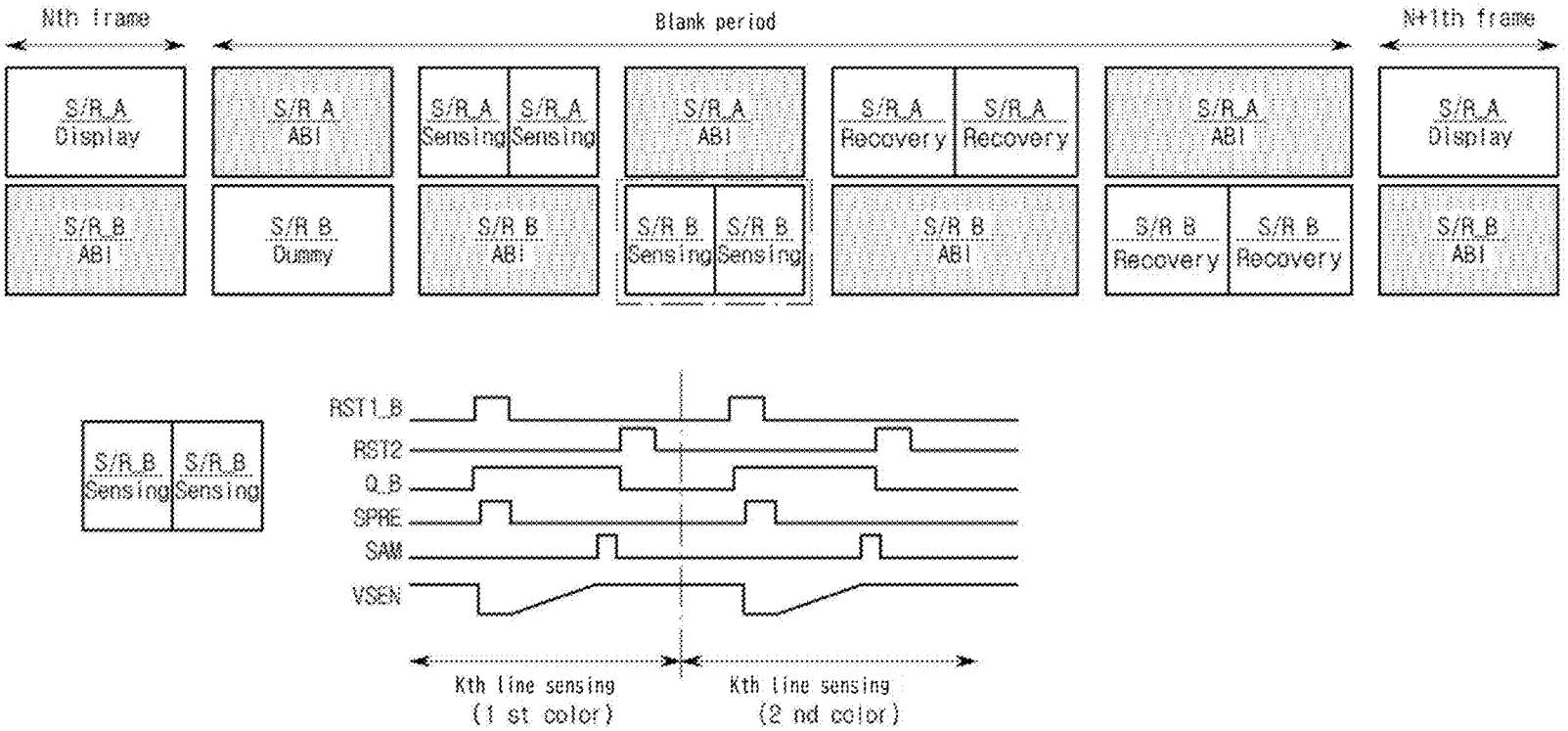

Referring to FIG. 10C, it is shown that the sensing operation is performed twice by the shift register B. Specifically, the shift register B receives the RST1 B signal in a local way. Here, the carry charged in the node M in the $N^{th}$ frame period moves to the node Q. Then, the shift register B receives the RST2 signal in a global way. Here, the carry charged in the node Q is discharged. While the carry is charged in the node Q, sensing is performed on the subpixels having one color among the subpixels included in the $K^{th}$ gate line to which the shift register B is connected. Subsequently, the shift register B receives the RST1 B signal again in a local way, and thus, the carry charged in the node M moves to the node Q. Also, the shift register B receives the RST2 signal in a global way, and thus, the carry charged in the node Q is discharged. While the carry is charged in the node Q, sensing is performed on the subpixels having another one color among the subpixels included in the $K^{th}$ gate line to which the shift register B is connected. That is, in this period, the sensing is performed twice in total, and compensation is performed for each of the subpixels having one color.

Figure 10D:
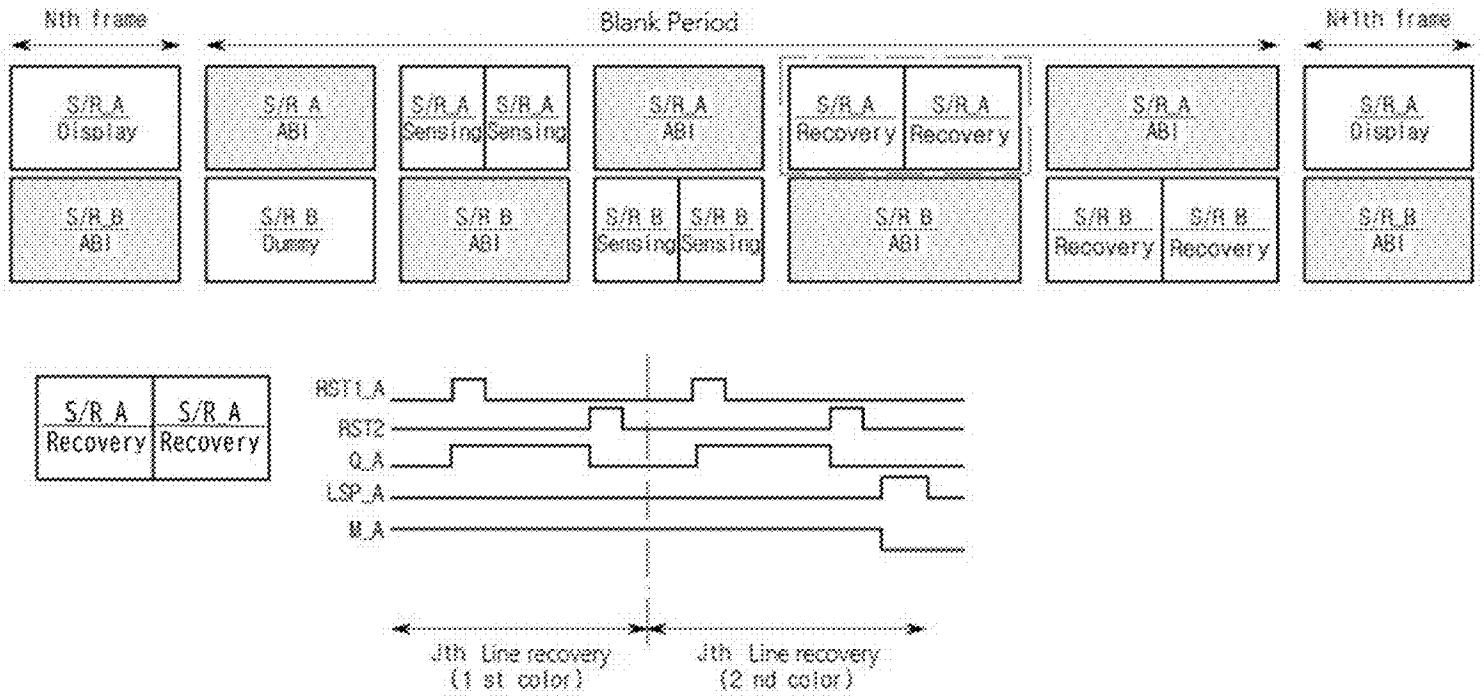

Referring to FIG. 10D, it is shown that the recovery operation is performed twice by the shift register A. Specifically, the shift register A receives the RST1 A signal in a local way. Here, the carry charged in the node M moves to the node Q. Then, the shift register A receives the RST2 signal in a global way. Here, the carry charged in the node Q is discharged. While the carry is charged in the node Q, data recovery is performed on the subpixels having one color among the subpixels included in the previously sensed $J^{th}$ gate line. Subsequently, the shift register A receives the RST1 A signal in a local way, and thus, the carry charged in the node M moves to the node Q. Subsequently, the shift register A receives the RST2 signal in a global way, and thus, the carry charged in the node Q is discharged. While the carry is charged in the node Q, data recovery is performed on the subpixels having another one color among the subpixels included in the previously sensed $J^{th}$ gate line. Subsequently, the shift register A receives the LSP A signal in a local way, and thus, the carry charged in the node M is discharged.

Figure 10E:
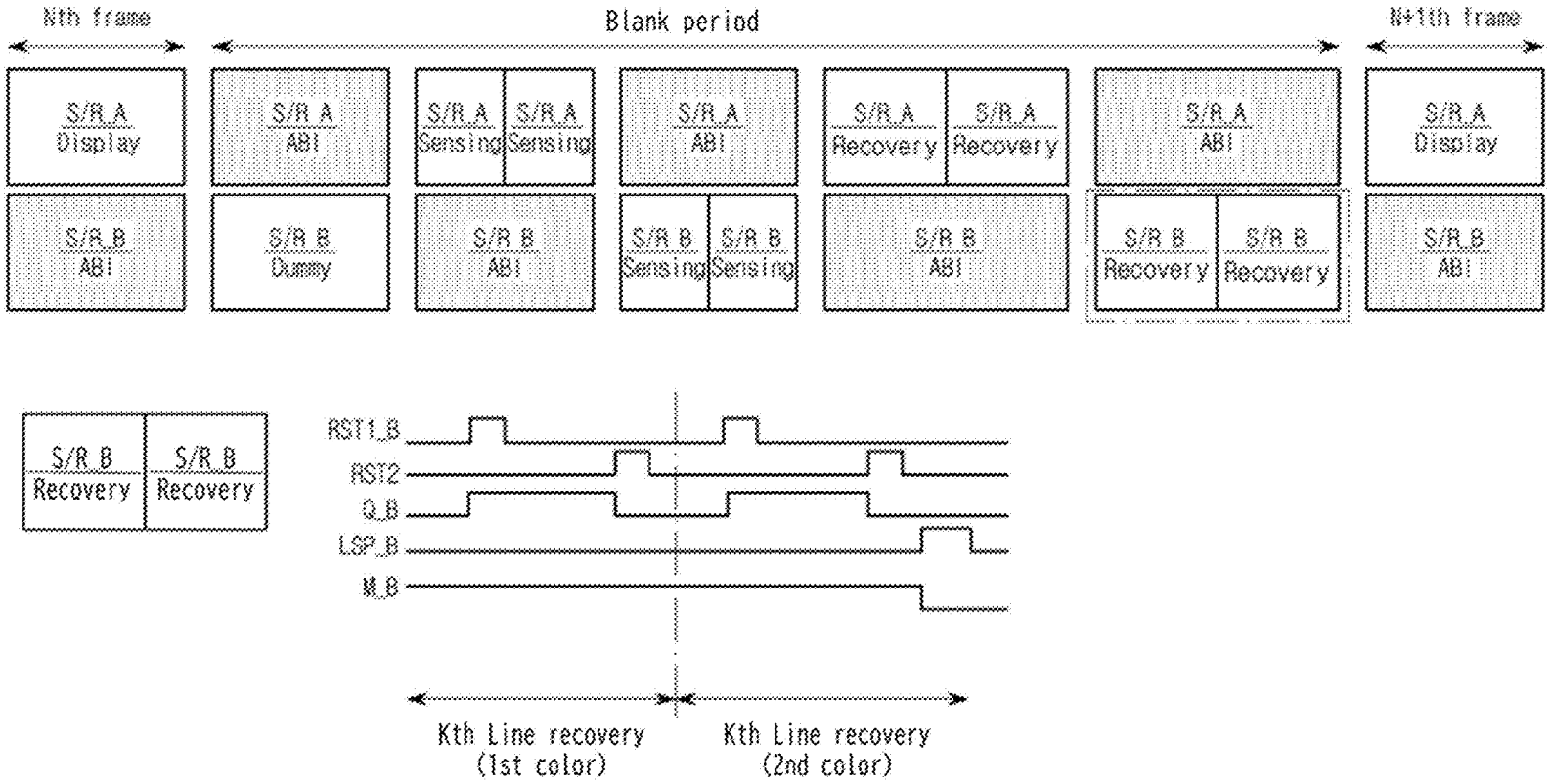

Referring to FIG. 10E, it is shown that the recovery operation is performed twice by the shift register B. Specifically, the shift register B receives the RST1 B signal in a local way. Here, the carry charged in the node M moves to the node Q. Then, the shift register B receives the RST2 signal in a global way. Here, the carry charged in the node Q is discharged. While the carry is charged in the node Q, data recovery is performed on the subpixels having one color among the subpixels included in the previously sensed $K^{th}$ gate line. Subsequently, the shift register B receives the RST1 B signal in a local way, and thus, the carry charged in the node M moves to the node Q. Subsequently, the shift register B receives the RST2 signal in a global way, and thus, the carry charged in the node Q is discharged. While the carry is charged in the node Q, data recovery is performed on the subpixels having another one color among the subpixels included in the previously sensed $K^{th}$ gate line. Subsequently, the shift register B receives the LSP B signal in a local way, and thus, the carry charged in the node M is discharged.

Figure 11:
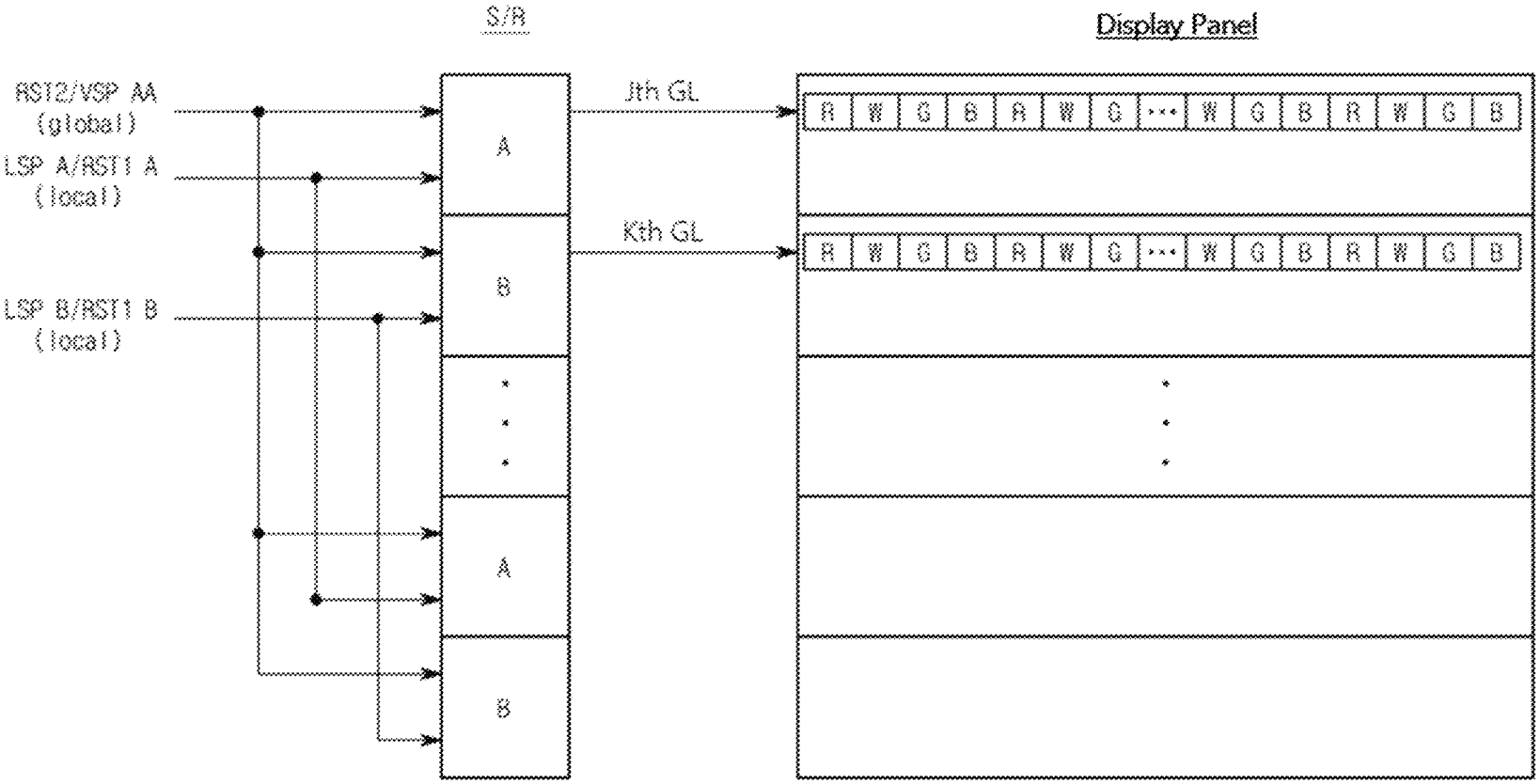
FIG. 11 is a view showing the display device which performs the sensing according to the embodiment of the present disclosure.

FIG. 11 is a view showing the display device which performs the sensing according to the embodiment of the present disclosure.

Referring to FIG. 11, a plurality of the shift registers (S/R) A and B are shown, and the display panel is shown. The shift register A receives the RST2 signal and the VSP AA signal in a global way, and receives the LSP A signal and the RST1 A signal in a local way. The shift register B receives the RST2 signal and the VSP AA signal in a global way, and receives the LSP B signal and the RST1 B signal in a local way. Such shift registers may be implemented as a gate-in-panel (GIP) disposed within the display panel. Although not shown, the display device may also include the data driver which supplies the data voltage to the plurality of subpixels within the display panel.

The shift register A is connected to the $J^{th}$ gate line, and the shift register B is connected to the $K^{th}$ gate line. According to the embodiment of the present disclosure, the shift register A senses the subpixels connected to the $J^{th}$ gate line, and the shift register B senses the subpixels connected to the $K^{th}$ gate line.

The LSP A signal charges the node M within the shift register A. That is, when the shift register A receives the LSP A signal, the node M is charged. Such an LSP A signal may be applied to the shift register A while the black screen is displayed on the display panel.

The LSP B signal charges the node M within the shift register B. That is, when the shift register B receives the LSP B signal, the node M is charged. Such an LSP B signal may be applied to the shift register B while the black screen is displayed on the display panel.

The RST1 signal moves a carry charged in the node M within the shift register A or the shift register B to the node Q. That is, when the shift register A receives the RST1 signal, the shift register A moves the carry charged in the node M to the node Q. Also, when the shift register B receives the RST1 signal, the shift register B moves the carry charged in the node M to the node Q. Such an RST1 signal may be applied to the shift register A or the shift register B before the sensing of the subpixel is started.

The RST2 signal discharges the carry charged in the node Q within the shift register A or the shift register B. That is, when the shift register A receives the RST2 signal, the carry charged in the node Q is discharged. Also, when the shift register B receives the RST2 signal, the carry charged in the node Q is discharged. Such an RST2 signal may be applied to the shift register A or the shift register B after the sensing of the subpixel is finished.

The VSP AA signal discharges forcibly the carry charged in the node Q within the shift register A and the shift register B.

According to the embodiment of the present disclosure, the node M of the shift register A is charged in the $N^{th}$ frame period, and the node M of the shift register B is charged in the $N^{th}$ frame period. Accordingly, a below-described preliminary operation for sensing is performed on the $J^{th}$ gate line and the $K^{th}$ gate line.

In the next blank period to the $N^{th}$ frame period, the subpixels connected to the $J^{th}$ gate line are sensed by the shift register A, and in the same blank period, the subpixels connected to the $K^{th}$ gate line are sensed by the shift register B.

Specifically, sensing of the subpixels connected to the $J^{th}$ gate line is performed twice. After the sensing of the subpixels having one color is performed in one sensing operation, the sensing of the subpixels having another one color is performed.

After the sensing of the $J^{th}$ gate line is terminated, the sensing of the $K^{th}$ gate line is performed. Similarly, the sensing is performed twice. After the sensing of the subpixels having one color is performed in one sensing operation, the sensing of the subpixels having another one color is performed.

In order to perform such a sensing operation, in the frame period before the blank period, the shift register A receives the LSP A signal through a line connected in a local way, and accordingly, the carry is charged to the node M. Also, in the frame period before the blank period, the shift register B receives the LSP B signal through a line connected in a local way, and accordingly, the carry is charged in the node M.

Before the subpixels are sensed in the blank period, the shift register A receives the RST1 A signal through a line connected in a local way. Also, the shift register A receives the RST2 signal through a line connected in a global way. The carry charged in node M is charged in node Q in a period between the RST1 A signal and the RST2 signal.

Similarly, before the subpixels are sensed in the blank period, the shift register B receives the RST1 B signal through a line connected in a local way. Also, the shift register B receives the RST2 signal through a line connected in a global way. The carry charged in node M is charged in node Q in a period between the RST1 B signal and the RST2 signal.

In the subsequent $N+1^{th}$ frame period, the LSP A signal and the LSP B signals are generated. As described above, the LSP A signal is received by the shift register A in a local way, and the node M of the shift register A which has received the LSP A signal is charged. Also, the LSP B signal is received by the shift register B in a local way, and the node M of the shift register B which has received the LSP B signal is charged. Accordingly, a preliminary operation for sensing is performed on the $J+1^{th}$ gate line and the $K+1^{th}$ gate line in the next blank period.

It can be understood by those skilled in the art that the embodiments can be embodied in other specific forms without departing from its spirit or essential characteristics. Therefore, the foregoing embodiments and advantages are merely exemplary and are not to be construed as limiting the present disclosure. It can be understood by those skilled in the art that the embodiments can be embodied in other specific forms without departing from its spirit or essential characteristics. Therefore, the foregoing embodiments and advantages are merely exemplary and are not to be construed as limiting the present disclosure. The scopes of the embodiments are described by the scopes of the following claims rather than by the foregoing description. All modification, alternatives, and variations derived from the scope and the meaning of the scope of the claims and equivalents of the claims should be construed as being included in the scopes of the embodiments.

REFERENCE NUMERALS

10: timing controller
20: gate driver
30: data driver
40: power supply unit
50: display panel The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A sensing method for compensation, which is performed while a display device is being driven, the sensing method comprising:

charging, in an $N^{th}$ frame period, a node M of a first shift register connected to a $j^{th}$ gate line of a display panel;

charging, in the $N^{th}$ frame period, a node M of a second shift register connected to a $K^{th}$ gate line of the display panel;

sensing, in a next blank period to the $N^{th}$ frame period, subpixels connected to the $j^{th}$ gate line; and sensing subpixels connected to the $K^{th}$ gate line in the blank period, wherein the sensing the subpixels connected to the $j^{th}$ gate line includes: sensing the subpixels having a first color among the subpixels connected to the $j^{th}$ gate line, and sensing the subpixels having a second color among the subpixels connected to the $j^{th}$ gate line, and wherein the sensing the subpixels having the first color among the subpixels connected to the $j^{th}$ gate line includes: receiving a first charge relocation signal, by the first shift register, through a line connected in a local way, moving a carry charged in the node M of the first shift register to a node Q, and charging the node Q of the first shift register with the carry.

2. The sensing method of claim 1, wherein, after the sensing the subpixels connected to the $j^{th}$ gate line is terminated, the sensing the subpixels connected to the $K^{th}$ gate line is performed.

3. The sensing method of claim 1, wherein the charging the node M of the first shift register includes receiving a first charging signal, by the first shift register, through a line connected in a local way, and wherein the charging the node M of the second shift register includes receiving a second charging signal, by the second shift register, through a line connected in the local way.

4. The sensing method of claim 1, further comprising: after the subpixels having the first color are sensed:

receiving a first discharging signal, by the first shift register, through a line connected in a global way; and discharging the node Q of the first shift register.

5. The sensing method of claim 1, wherein, in the blank period, the subpixels having the first color and the subpixels having the second color among the subpixels connected to the $j^{th}$ gate line are sensed, and wherein, in the blank period, the subpixels having the first color and the subpixels having the second color among the subpixels connected to the $K^{th}$ gate line are sensed.

6. A sensing method for compensation, which is performed while a display device is being driven, the sensing method comprising:

charging, in an $N^{th}$ frame period, a node M of a first shift register connected to a $j^{th}$ gate line of a display panel;

charging, in the $N^{th}$ frame period, a node M of a second shift register connected to a $K^{th}$ gate line of the display panel;

sensing, in a next blank period to the $N^{th}$ frame period, subpixels connected to the $j^{th}$ gate line; and sensing subpixels connected to the $K^{th}$ gate line in the blank period, wherein the sensing the subpixels connected to the $K^{th}$ gate line includes: sensing the subpixels having a first color among the subpixels connected to the $K^{th}$ gate line, and sensing the subpixels having a second color among the subpixels connected to the $K^{th}$ gate line, and wherein the sensing the subpixels having the first color among the subpixels connected to the $K^{th}$ gate line includes:

receiving a second charge relocation signal, by the second shift register, through a line connected in a local way;

moving a carry charged in the node M of the second shift register to a node Q; and charging the node Q of the second shift register with the carry.

7. The sensing method of claim 6, further comprising: after the subpixels having the first color are sensed:

receiving a first discharging signal, by the second shift register, through a line connected in a global way; and discharging the node Q of the second shift register.

8. A display device which performs sensing for compensation, which is performed while the display device is being driven, the display device comprising:

a display panel including a plurality of subpixels;

a gate driver connected with the subpixels through gate lines including a $j^{th}$ gate line and a $K^{th}$ gate line; and a data driver connected to the subpixels through a data line, wherein the gate driver includes:

a first shift register configured to:

receive a first discharging signal in a global way, receive a first charging signal and a first charge relocation signal in a local way, and connect with the $j^{th}$ gate line; and a second shift register configured to:

receive the first discharging signal in the global way, receive a second charging signal and a second charge relocation signal in the local way, and connect with the $K^{th}$ gate line, wherein, in an $N^{th}$ frame period, a node M of the first shift register is charged, and wherein, in the $N^{th}$ frame period, a node M of the second shift register is charged, wherein, in a next blank period to the $N^{th}$ frame period, the subpixels connected to the $j^{th}$ gate line are sensed, and wherein, in the blank period, the subpixels connected to the $K^{th}$ gate line are sensed, wherein the sensed subpixels connected to the $j^{th}$ gate line include the subpixels having a first color and the subpixels having a second color, and wherein the first shift register receives the first charge relocation signal through a line connected in the local way before the subpixels having the first color are sensed so that a carry charged in the node M of the first shift register is moved a node Q, and the node Q of the first shift register is charged with the carry.

9. The display device of claim 8, wherein the sensed subpixels connected to the $K^{th}$ gate line include the subpixels having the first color and the subpixels having the second color.

10. The display device of claim 8, wherein the first shift register receives the first charging signal through a line connected in the local way, and wherein the second shift register receives the second charging signal through a line connected in the local way.

11. The display device of claim 8, wherein the first shift register receives the first discharging signal through a line connected in the global way after the subpixels having the first color are sensed.

12. The display device of claim 9, wherein the second shift register receives the second charge relocation signal through a line connected in the local way before the subpixels having the first color are sensed.

13. The display device of claim 12, wherein the second shift register receives the first discharging signal through a line connected in the global way after the subpixels having the first color are sensed.

14. The display device of claim 8, wherein, in a blank period between an $N^{th}$ frame period and an $N+1^{th}$ frame period, a portion of subpixels among the subpixels connected to the $j^{th}$ gate line are sensed, and wherein, in the blank period, a portion of subpixels among the subpixels connected to the $K^{th}$ gate line are sensed.

15. The display device of claim 14, wherein the sensed subpixels connected to the $j^{th}$ gate line are the subpixels having the first color and the subpixels having the second color, and wherein the sensed subpixels connected to the $K^{th}$ gate line are the subpixels having the first color and the subpixels having the second color.

* * * * *